US012013139B2

(12) United States Patent
Hikawa et al.

(10) Patent No.: US 12,013,139 B2
(45) Date of Patent: Jun. 18, 2024

(54) AIR CONDITIONING APPARATUS, MANAGEMENT DEVICE, AND CONNECTION PIPE

(71) Applicant: DAIKIN INDUSTRIES, LTD., Osaka (JP)

(72) Inventors: Takeshi Hikawa, Osaka (JP); Shinichi Kasahara, Osaka (JP); Manabu Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 531 days.

(21) Appl. No.: 17/280,643

(22) PCT Filed: Sep. 27, 2019

(86) PCT No.: PCT/JP2019/038176
§ 371 (c)(1),
(2) Date: Mar. 26, 2021

(87) PCT Pub. No.: WO2020/067428
PCT Pub. Date: Apr. 2, 2020

(65) Prior Publication Data

US 2021/0341170 A1 Nov. 4, 2021

(30) Foreign Application Priority Data

Sep. 27, 2018 (JP) ..... 2018-181648

(51) Int. Cl.
*F25B 49/02* (2006.01)
*F24F 3/06* (2006.01)
(Continued)

(52) U.S. Cl.
CPC ..... *F24F 11/86* (2018.01); *F24F 3/065* (2013.01); *F24F 11/36* (2018.01); *F24F 11/49* (2018.01);
(Continued)

(58) Field of Classification Search
CPC ..... F24F 11/49; F24F 2140/20; F25B 41/31; F25B 49/02; F25B 2600/2513; F25B 2700/21
See application file for complete search history.

(56) References Cited

U.S. PATENT DOCUMENTS

2009/0126375 A1 5/2009 Toyoshima et al.
2013/0067942 A1 3/2013 Ochiai et al.
(Continued)

FOREIGN PATENT DOCUMENTS

EP 1 942 307 A2 7/2008
EP 2 017 556 A1 1/2009
(Continued)

OTHER PUBLICATIONS

JP 11-83250 (English translation) (Year: 1999).*
(Continued)

*Primary Examiner* — Jonathan Bradford
(74) *Attorney, Agent, or Firm* — Birch, Stewart, Kolasch & Birch, LLP

(57) ABSTRACT

An air conditioning apparatus includes a refrigerant circuit in which a plurality of indoor units respectively including an indoor heat exchanger and an indoor expansion valve are connected to an outdoor unit including an outdoor expansion valve via a liquid-refrigerant connection pipe. The air conditioning apparatus individually controls each of the indoor units to operate or stop. The air conditioning apparatus includes a controller. When at least one of the indoor heat exchangers functions as a radiator, the controller controls an opening degree of the indoor expansion valve and an opening degree of the outdoor expansion valve. The apparatus—determines whether a refrigerant amount in the refrigerant circuit is appropriate on the basis of an amount of change
(Continued)

corresponding to a change in state of a refrigerant between the indoor expansion valve and the outdoor expansion valve.

20 Claims, 14 Drawing Sheets

(51) Int. Cl.

| | |
|---|---|
| ***F24F 11/36*** | (2018.01) |
| ***F24F 11/49*** | (2018.01) |
| ***F24F 11/86*** | (2018.01) |
| ***F25B 41/31*** | (2021.01) |
| ***F25B 45/00*** | (2006.01) |
| *F24F 11/84* | (2018.01) |
| *F24F 110/10* | (2018.01) |
| *F24F 110/12* | (2018.01) |
| *F24F 140/20* | (2018.01) |
| *F25B 13/00* | (2006.01) |

(52) U.S. Cl.

CPC ..... *F25B 41/31* (2021.01); *F25B 45/00* (2013.01); *F25B 49/02* (2013.01); *F24F 11/84* (2018.01); *F24F 2110/10* (2018.01); *F24F 2110/12* (2018.01); *F24F 2140/20* (2018.01); *F24F 2221/54* (2013.01); *F25B 13/00* (2013.01); *F25B 2313/0233* (2013.01); *F25B 2313/0293* (2013.01); *F25B 2313/0314* (2013.01); *F25B 2345/006* (2013.01); *F25B 2400/13* (2013.01); *F25B 2600/2513* (2013.01); *F25B 2700/1931* (2013.01); *F25B 2700/21* (2013.01)

(56) References Cited

U.S. PATENT DOCUMENTS

2013/0118197 A1 5/2013 Kibo et al.
2016/0356534 A1 12/2016 Hatada et al.

FOREIGN PATENT DOCUMENTS

| | | | |
|---|---|---|---|
| EP | 2 068 101 | A1 | 6/2009 |
| EP | 2 767 776 | A1 | 8/2014 |
| EP | 3 051 236 | A1 | 8/2016 |
| JP | 8-121917 | A | 5/1996 |
| JP | 11-83250 | A | 3/1999 |
| JP | 2006-23072 | A | 1/2006 |
| JP | 2008-96051 | A | 4/2008 |
| JP | 2008-164265 | A | 7/2008 |
| JP | 2009-210142 | A | 9/2009 |
| JP | 2012-26686 | A | 2/2012 |
| JP | 2012-32108 | A | 2/2012 |
| JP | 5164527 | B2 | 3/2013 |
| JP | 2014-115011 | A | 6/2014 |
| JP | 2015-135192 | A | 7/2015 |
| JP | 2016-133274 | A | 7/2016 |
| JP | 2017-75760 | A | 4/2017 |
| JP | 6130921 | B2 | 5/2017 |
| JP | 6310054 | B2 | 4/2018 |
| WO | WO 2007/049372 | A1 | 5/2007 |
| WO | WO 2010/023894 | A1 | 3/2010 |
| WO | WO 2011/161720 | A1 | 12/2011 |

OTHER PUBLICATIONS

International Search Report issued in PCT/JP2019/038176 (PCT/ISA/210), dated Dec. 10, 2019.

International Preliminary Report on Patentability and English translation of the Written Opinion of the International Searching Authority, for International Application No. PCT/JP2019/038176, dated Apr. 8, 2021.

Extended European Search Report for corresponding European Application No. 19864438.7, dated Feb. 18, 2022.

* cited by examiner

AIR CONDITIONING APPARATUS, MANAGEMENT DEVICE, AND CONNECTION PIPE

TECHNICAL FIELD

The present disclosure relates to an air conditioning apparatus, a management device, and a connection pipe.

BACKGROUND ART

Conventionally, an air conditioning apparatus capable of determining whether the refrigerant amount is appropriate even when the outdoor air temperature is low, for example, in winter has been studied. For example, PTL 1 (Japanese Patent No. 5164527) discloses an air conditioner that calculates an appropriate refrigerant amount in a cooling cycle on the basis of the capacity of an outdoor heat exchanger, calculates a target subcooling degree of an indoor heat exchanger in a heating cycle with reference to the appropriate refrigerant amount in the cooling cycle, and determines the appropriate refrigerant amount of a refrigeration cycle on the basis of the target subcooling degree.

SUMMARY OF INVENTION

Technical Problem

With the technology described in the above-described PTL 1, however, the range of change in the subcooling degree with respect to the change in the refrigerant amount is small, and hence it may be difficult to highly accurately determine whether the refrigerant amount is appropriate.

Solution to Problem

An air conditioning apparatus according to a first aspect includes a refrigerant circuit in which a plurality of indoor units respectively including indoor heat exchangers and indoor expansion mechanisms are connected to an outdoor unit including an outdoor expansion mechanism via a connection pipe. Moreover, the air conditioning apparatus individually controls each of the indoor units to operate or stop. In this case, the air conditioning apparatus includes a control unit and a determination unit. When at least one of the indoor heat exchangers functions as a radiator, the control unit controls an opening degree of a corresponding one of the indoor expansion mechanisms and an opening degree of the outdoor expansion mechanism. The determination unit determines whether a refrigerant amount in the refrigerant circuit is appropriate on the basis of an amount of change corresponding to a change in state of a refrigerant between the indoor expansion mechanism and the outdoor expansion mechanism. Thus, the air conditioning apparatus capable of highly accurately determining whether the refrigerant amount in the refrigerant circuit is appropriate can be provided.

An air conditioning apparatus according to a second aspect is the air conditioning apparatus according to the first aspect, in which the outdoor unit further includes a compressor, an outdoor heat exchanger, a switching mechanism, and a container. In this case, the compressor compresses and discharges a refrigerant. The switching mechanism switches a flow path of a refrigerant to cause the indoor heat exchanger to function as a radiator or an evaporators. The container is connected to an upstream-side pipe of the refrigerant circuit to store a refrigerant, the upstream-side pipe being located upstream of the compressor. With such a configuration, the air conditioning apparatus capable of performing cooling and heating operation that causes an excessive refrigerant to be generated in heating operation and capable of highly accurately determining whether the refrigerant amount in the refrigerant circuit is appropriate can be provided.

An air conditioning apparatus according to a third aspect is the air conditioning apparatus according to the second aspect, in which the outdoor unit further includes a branch pipe and a branch-pipe expansion mechanism. The branch pipe connects an upstream-side pipe located upstream of the outdoor heat exchanger to the upstream-side pipe located upstream of the compressor in operation in which the outdoor heat exchanger is used as an evaporator. The branch-pipe expansion mechanism is disposed in the branch pipe.

An air conditioning apparatus according to a fourth aspect is the air conditioning apparatus according to any one of the first to third aspects, in which the determination unit determines the amount of change on the basis of an opening degree ratio of the opening degree of the indoor expansion mechanism to the opening degree of the outdoor expansion mechanism.

An air conditioning apparatus according to a fifth aspect is the air conditioning apparatus according to any one of the first to fourth aspects, in which each of the indoor expansion mechanisms is connected in series to the outdoor expansion mechanism via a connection pipe. The determination unit determines the amount of change on the basis of a temperature of the connection pipe between the indoor expansion mechanism and the outdoor expansion mechanism.

An air conditioning apparatus according to a sixth aspect is the air conditioning apparatus according to the fifth aspect, in which a temperature of the connection pipe is measured by a temperature sensor disposed in the outdoor unit. Accordingly, it can be highly accurately determined whether the refrigerant amount in the refrigerant circuit is appropriate using the simple configuration.

An air conditioning apparatus according to a seventh aspect is the air conditioning apparatus according to the fifth aspect, in which a temperature of the connection pipe is measured by a temperature sensor disposed at a position located downstream of a position at which pipes from the plurality of indoor expansion mechanisms are joined. At such a position, a change in state is sensitively reflected on a change in temperature. It can be highly accurately determined whether the refrigerant amount in the refrigerant circuit is appropriate.

An air conditioning apparatus according to an eighth aspect is the air conditioning apparatus according to the fifth aspect, in which a temperature of the connection pipe is measured by temperature sensors respectively disposed in the plurality of indoor units. Accordingly, it can be highly accurately determined whether the refrigerant amount in the refrigerant circuit is appropriate using the simple configuration.

An air conditioning apparatus according to a ninth aspect is the air conditioning apparatus according to any one of the first to eighth aspects, in which, when the determination unit determines whether a refrigerant amount is appropriate, the determination unit makes determination depending on whether an operating state of the indoor unit is a thermo-on state, a thermo-off state, or a stop state.

In the air conditioning apparatus according to the ninth aspect, since the determination unit determines whether the refrigerant amount is appropriate depending on the operating state of the indoor unit, the determination unit can make determination further highly accurately.

An air conditioning apparatus according to a tenth aspect is the air conditioning apparatus according to any one of the first to ninth aspects, in which, when the determination unit determines whether a refrigerant amount is appropriate, in a case where an indoor fan operates in a thermo-off state, after the control unit stops the indoor fan of the indoor unit in the thermo-off state, the determination unit determines whether a refrigerant amount is appropriate.

In the air conditioning apparatus according to the tenth aspect, since the determination unit determines whether the refrigerant amount is appropriate in the state in which the retaining amount of the refrigerant in the indoor unit has been decreased, the determination unit can make determination further appropriately.

An air conditioning apparatus according to an eleventh aspect is the air conditioning apparatus according to any one of the first to tenth aspects, in which, the determination unit acquires a relationship between system-state-amount data for an appropriate refrigerant amount and an index of the amount of change in advance, and when the determination unit determines whether a refrigerant amount is appropriate, the determination unit determines whether the refrigerant amount is appropriate by using the relationship to compare an index of the amount of change that is estimated on the basis of current system-state-amount data to a current index of the amount of change.

In the air conditioning apparatus according to the eleventh aspect, since the current index of the amount of change is determined by using the relationship between the system-state-amount data for the appropriate refrigerant amount and the index of the amount of change, more appropriate determination can be made.

An air conditioning apparatus according to a twelfth aspect is the air conditioning apparatus according to the eleventh aspect, in which an index of the amount of change is a temperature of the connection pipe between the indoor expansion mechanism and the outdoor expansion mechanism.

In the air conditioning apparatus according to the twelfth aspect, since the temperature of the connection pipe between the indoor expansion mechanism and the outdoor expansion mechanism is used as the index of the amount of change, it can be easily determined whether the refrigerant amount is appropriate.

An air conditioning apparatus according to a thirteenth aspect is the air conditioning apparatus according to the eleventh aspect, in which an index of the amount of change is (an intermediate-pressure correspondence value−a low-pressure correspondence value)/(a high-pressure correspondence value−the low-pressure correspondence value). In this case, a pressure of a refrigerant discharged from the compressor is a high pressure, and a physical property value corresponding to the high pressure is the high-pressure correspondence value. Moreover, a pressure of a refrigerant before being sucked to the compressor is a low pressure, and a physical property value corresponding to the low pressure is the low-pressure correspondence value. Moreover, a pressure of the connection pipe between the indoor expansion mechanism and the outdoor expansion mechanism is an intermediate pressure, and a physical property value corresponding to the intermediate pressure is the intermediate-pressure correspondence value.

In the air conditioning apparatus according to the thirteenth aspect, since (the intermediate-pressure correspondence value−the low-pressure correspondence value)/(the high-pressure correspondence value−the low-pressure correspondence value) is used as the index of the amount of change, determination on the appropriate refrigerant amount can be further accurately made.

An air conditioning apparatus according to a fourteenth aspect is the air conditioning apparatus according to any one of the eleventh to thirteenth aspects, in which the system-state-amount data includes at least one of a number of revolutions of the compressor, an indoor-unit capacity, an outside air temperature, and an opening degree of a sub-cooling expansion mechanism.

An air conditioning apparatus according to a fifteenth aspect is the air conditioning apparatus according to any one of the eleventh to fourteenth aspects, in which, when the determination unit determines whether a refrigerant amount is appropriate, the system-state-amount data and index data of the amount of change to be used are only data acquired in a state of a compressor suction superheating degree >0.

In the air conditioning apparatus according to the fifteenth aspect, since only the data acquired in the state of the compressor suction superheating degree >0 is used, the data is acquired in a state in which the refrigerant is almost not stored in the container for storing the refrigerant, and hence determination on the appropriate refrigerant amount can be further correctly made.

An air conditioning apparatus according to a sixteenth aspect includes a refrigerant circuit in which a plurality of indoor units respectively including indoor heat exchangers and indoor expansion mechanisms are connected to an outdoor unit including an outdoor expansion mechanism via a connection pipe. Moreover, the air conditioning apparatus individually controls each of the indoor units to operate or stop. In this case, the air conditioning apparatus includes a control unit and a communication unit. When at least one of the indoor heat exchangers functions as a radiator, the control unit controls an opening degree of a corresponding one of the indoor expansion mechanisms and an opening degree of the outdoor expansion mechanism. The communication unit transmits an amount of change corresponding to a change in state between the indoor expansion mechanism and the outdoor expansion mechanism, to a management device. The management device determines whether a refrigerant amount in the refrigerant circuit is appropriate on the basis of the amount of change corresponding to a change in state of a refrigerant between the indoor expansion mechanism and the outdoor expansion mechanism. With this configuration, calculation load of the air conditioning apparatus can be reduced, and an administrator of the management device can manage whether the refrigerant amount in the refrigerant circuit is appropriate.

A management device according to a seventeenth aspect is communicable with an air conditioning apparatus. In this case, the air conditioning apparatus includes a refrigerant circuit in which a plurality of indoor units respectively including indoor heat exchangers and indoor expansion mechanisms are connected to an outdoor unit including an outdoor expansion mechanism via a connection pipe. Moreover, the air conditioning apparatus individually controls each of the indoor units to operate or stop. Moreover, the air conditioning apparatus further includes a control unit that, when at least one of the indoor heat exchangers functions as a radiator, controls an opening degree of a corresponding one of the indoor expansion mechanisms and an opening degree of the outdoor expansion mechanism. The management device acquires an amount of change corresponding to a change in state of a refrigerant between the indoor expansion mechanism and the outdoor expansion mechanism, and determines whether a refrigerant amount in the refrigerant circuit is appropriate on the basis of the acquired amount of change. With this configuration, calculation load of the air conditioning apparatus can be reduced, and an administrator of the management device can manage whether the refrigerant amount in the refrigerant circuit is appropriate.

A pipe according to an eighteenth aspect is a connection pipe that is used in the air conditioning apparatus according to any one of the sixth to eighth aspects, and the temperature sensor is provided at the connection pipe. With such a configuration, the connection pipe for highly accurately determining whether the refrigerant amount in the refrigerant circuit is appropriate can be provided.

DESCRIPTION OF EMBODIMENTS

Air conditioning apparatuses according to the present disclosure are described below with reference to the drawings.

First Embodiment (1) Configuration of Air Conditioning Apparatus

Figure 1:
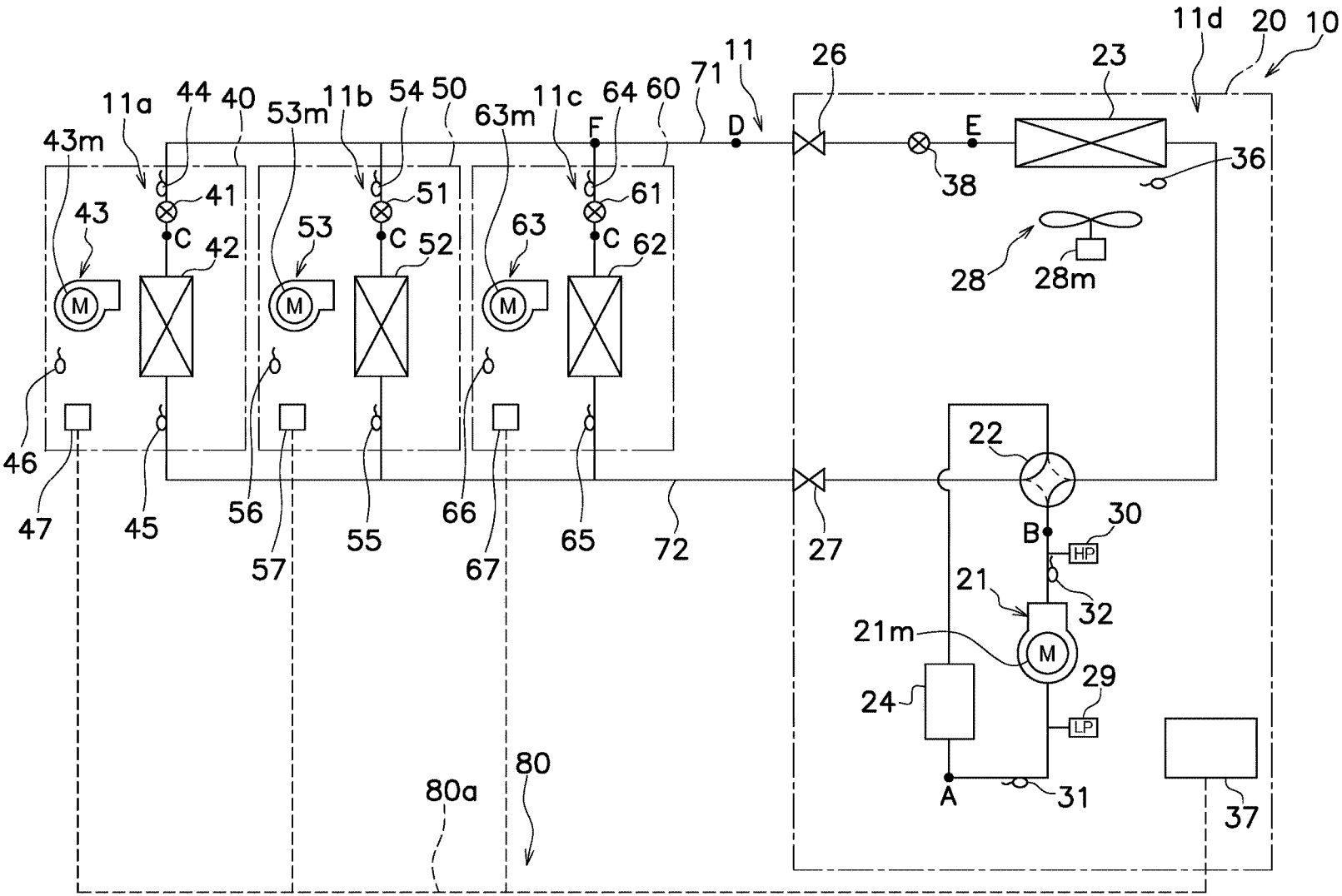
FIG. 1 is a schematic configuration diagram of an air conditioning apparatus 10 according to a first embodiment.

An air conditioning apparatus 10 is an apparatus that is used for cooling and heating in a room of a building or the like through a vapor compression refrigeration cycle operation as illustrated in FIG. 1. The air conditioning apparatus 10 mainly includes an outdoor unit 20 serving as one heat source unit, indoor units 40, 50, and 60 serving as a plurality of (in the embodiment, three) use units that are connected in parallel to the outdoor unit 20, and a liquid-refrigerant connection pipe 71 and a gas-refrigerant connection pipe 72 serving as connection pipes that connect the outdoor unit 20 to each of the indoor units 40, 50, and 60. The outdoor unit 20 is connected to the plurality of the indoor units 40, 50, and 60 via the liquid-refrigerant connection pipe 71 and the gas-refrigerant connection pipe 72 to constitute a refrigerant circuit 11.

Moreover, the air conditioning apparatus 10 can individually control each of the indoor units 40, 50, and 60 to operate or stop.

(1-1) Indoor Units

Next, configurations of the indoor units 40, 50, and 60 are described. Note that the indoor unit 40 has a configuration similar to those of the indoor units 50 and 60, hence only the configuration of the indoor unit 40 is described here, and the description on the configurations of the indoor units 50 and 60 is omitted while reference signs from 51 to 59 or reference signs from 61 to 69 are applied to components of the indoor units 50 and 60 instead of reference signs from 41 to 49 for components of the indoor unit 40.

The indoor unit 40 is installed, for example, by being embedded in or hung from a ceiling in a room of a building or the like, or by being hooked to a wall surface in the room. The indoor unit 40 is connected to the outdoor unit 20 via the liquid-refrigerant connection pipe 71 and the gas-refrigerant connection pipe 72 and constitutes part of the refrigerant circuit 11.

The indoor unit 40 mainly includes an indoor expansion valve 41 serving as an expansion mechanism, and an indoor heat exchanger 42 serving as a use-side heat exchanger. Moreover, the indoor unit 40 constitutes an indoor-side refrigerant circuit 11*a* (the indoor unit 50 constitutes an indoor-side refrigerant circuit 11*b*, and the indoor unit 60 constitutes an indoor-side refrigerant circuit 11*c*) that is part of the refrigerant circuit 11.

Note that, in the embodiment, an "expansion mechanism" is capable of decompressing a refrigerant, and corresponds to, for example, an electronic expansion valve or a capillary tube. The expansion mechanism also has an adjustable opening degree.

The indoor expansion valve 41 is an electronic expansion valve connected to the liquid side of the indoor heat exchanger 42, for example, for adjusting the flow rate of the refrigerant flowing in the indoor-side refrigerant circuit 11*a*. The indoor expansion valve 41 can also block passage of the refrigerant. Note that, in the embodiment, the opening degree of the indoor expansion valve 41 is adjusted to a slight opening degree when the indoor unit 40 is stopped in a state in which any one of the indoor units 50 and 60 is in operation. Thus, a situation in which a liquid refrigerant is accumulated in the indoor heat exchanger 42 is avoided. Note that the "slight opening degree" corresponds to a minimum predetermined value of a valve opening pulse, and represents a small opening degree to a certain extent that the indoor expansion valve 41 is not completely closed.

The indoor heat exchanger 42 is a device for exchanging heat between the air and the refrigerant. The indoor heat exchanger 42 functions as an evaporator of the refrigerant in cooling operation to cool the indoor air. The indoor heat exchanger 42 also functions as a condenser of the refrigerant in heating operation to heat the indoor air. For example, a cross-fin type fin-and-tube heat exchanger including a heat transfer tube and multiple fins can be used as the indoor heat exchanger 42. However, the indoor heat exchanger 42 is not limited to the above-mentioned example and may be a heat exchanger of another type.

The indoor unit 40 includes an indoor fan 43 serving as a fan. The indoor fan 43 sucks the air into the indoor unit 40 and supplies the air that has exchanged heat with the refrigerant in the indoor heat exchanger 42 to the inside of the room. For example, a centrifugal fan or a multiblade fan that is driven by a motor 43*m* including a DC fan motor or the like can be used as the indoor fan 43.

In addition, the indoor unit 40 is provided with various sensors. Specifically, a liquid-side temperature sensor 44, a gas-side temperature sensor 45, and an indoor temperature sensor 46 are provided. The liquid-side temperature sensor 44 detects the temperature of the refrigerant on the liquid side of the indoor heat exchanger 42. The liquid-side temperature sensor 44 is provided downstream of the indoor expansion valve 41 in a direction in which the refrigerant flows in heating operation. The gas-side temperature sensor 45 detects the temperature of the refrigerant on the gas side of the indoor heat exchanger 42. The indoor temperature sensor 46 detects the temperature of the indoor air flowing into the indoor unit 40 (that is, indoor temperature). The indoor temperature sensor 46 is provided on the indoor-air suction-port side of the indoor unit 40.

The indoor unit 40 also includes an indoor-side controller 47 that controls operation of components constituting the indoor unit 40. The indoor-side controller 47 has, for example, a microcomputer and a memory 47*a* provided for controlling the indoor unit 40, and hence can transmit and receive a control signal to and from a remote controller (not illustrated) for individually operating the indoor unit 40 and can transmit and receive a control signal to and from the outdoor unit 20 via a transmission line 80*a*.

(1-2) Outdoor Unit

The outdoor unit 20 is installed outside a room of a building or the like, and is connected to each of the indoor units 40, 50, and 60 via the liquid-refrigerant connection pipe 71 and the gas-refrigerant connection pipe 72. The outdoor unit 20 constitutes the refrigerant circuit 11 together with each of the indoor units 40, 50, and 60. Note that each of the indoor expansion valves 41, 51, and 61 is connected in series to an outdoor expansion valve 38 via the liquid-refrigerant connection pipe 71.

The outdoor unit 20 mainly includes a compressor 21, a four-way switching valve 22, an outdoor heat exchanger 23 serving as a heat-source-side heat exchanger, the outdoor expansion valve 38 serving as an expansion mechanism, an accumulator 24, a liquid-side shutoff valve 26, and a gas-side shutoff valve 27. The outdoor unit 20 also constitutes an outdoor-side refrigerant circuit 11*d* that is part of the refrigerant circuit 11.

The compressor 21 is a compressor having a variable operating capacity. For example, a positive-displacement compressor that is driven by a motor 21*m* whose number of revolutions is controlled by an inverter can be used as the compressor 21. Only one compressor 21 is illustrated here. Alternatively, two or more compressors may be connected in parallel in accordance with the number of connected indoor units.

The four-way switching valve 22 is a valve for switching the flow path of the refrigerant. In cooling operation, the four-way switching valve 22 connects the discharge side of the compressor 21 to the gas side of the outdoor heat exchanger 23, and connects the suction side of the compressor 21 (specifically, the accumulator 24) to the side near the gas-refrigerant connection pipe 72 (see solid lines of the four-way switching valve 22 in FIG. 1). Thus, the outdoor heat exchanger 23 functions as a condenser of the refrigerant that is compressed by the compressor 21, and each of the indoor heat exchangers 42, 52, and 62 functions as an evaporator of the refrigerant that is condensed in the outdoor heat exchanger 23. In heating operation, the four-way switching valve 22 connects the discharge side of the compressor 21 to the side near the gas-refrigerant connection pipe 72, and connects the suction side of the compressor 21 to the gas side of the outdoor heat exchanger 23 (see broken lines of the four-way switching valve 22 in FIG. 1). Thus, each of the indoor heat exchangers 42, 52, and 62 functions as a condenser of the refrigerant that is compressed by the compressor 21, and the outdoor heat exchanger 23 functions as an evaporator of the refrigerant that is condensed by each of the indoor heat exchangers 42, 52, and 62.

The outdoor heat exchanger 23 is a device for heat exchange between the air and the refrigerant. The outdoor heat exchanger 23 functions as a condenser of the refrigerant in cooling operation, and functions as an evaporator of the refrigerant in heating operation. The gas side of the outdoor heat exchanger 23 is connected to the four-way switching valve 22, and the liquid side thereof is connected to the outdoor expansion valve 38. For example, a cross-fin type fin-and-tube heat exchanger can be used as the outdoor heat exchanger 23. However, the outdoor heat exchanger 23 is not limited to the above-mentioned example and may be a heat exchanger of another type.

The outdoor unit 20 includes an outdoor fan 28 serving as a fan. The outdoor fan 28 is a fan capable of changing the airflow volume of the air to be supplied to the outdoor heat exchanger 23. The outdoor fan 28 sucks the outdoor air into the outdoor unit 20 and discharges the air that has exchanged heat with the refrigerant in the outdoor heat exchanger 23 to the outside of the room. For example, a propeller fan that is driven by a motor 28*m* including a DC fan motor or the like can be used as the outdoor fan 28.

The accumulator 24 is a container for storing an excessive refrigerant that represents a difference between the refrigerant circulating in the refrigerant circuit 11 when at least one of the indoor heat exchangers 42, 52, and 62 functions as a condenser and the refrigerant circulating in the refrigerant circuit 11 when at least one of the indoor heat exchangers 42, 52, and 62 functions as an evaporator. More specifically, the air conditioning apparatus 10 according to the embodiment can operate while being switched between cooling operation and heating operation. To increase annual performance factor (APF), the air conditioning apparatus 10 is designed such that the refrigerant is more excessive in heating operation than the refrigerant in cooling operation. The accumulator 24 stores such an excessive refrigerant as a liquid refrigerant.

The outdoor expansion valve 38 adjusts the pressure, flow rate, and so forth of the refrigerant flowing in the outdoor-side refrigerant circuit 11*d*. The outdoor expansion valve 38 is an electronic expansion valve that is disposed upstream of the outdoor heat exchanger 23 in the direction in which the refrigerant flows in heating operation (in the embodiment, connected to the liquid side of the outdoor heat exchanger 23).

The liquid-side shutoff valve 26 and the gas-side shutoff valve 27 are valves provided at connecting ports for external devices and pipes (specifically, the liquid-refrigerant connection pipe 71 and the gas-refrigerant connection pipe 72). The liquid-side shutoff valve 26 and the gas-side shutoff valve 27 can block passage of the refrigerant.

In addition, the outdoor unit 20 is provided with various sensors. Specifically, the outdoor unit 20 is provided with a suction pressure sensor 29 that detects the suction pressure of the compressor 21, a discharge pressure sensor 30 that detects the discharge pressure of the compressor 21, a suction temperature sensor 31 that detects the suction temperature of the compressor 21, and a discharge temperature sensor 32 that detects the discharge temperature of the compressor 21. An outdoor temperature sensor 36 is provided on the outdoor-air suction-port side of the outdoor unit 20. The outdoor temperature sensor 36 detects the temperature of the outdoor air flowing into the outdoor unit 20 (that is, outdoor temperature).

In addition, the outdoor unit 20 includes an outdoor-side controller 37 that controls operation of respective components that constitute the outdoor unit 20. The outdoor-side controller 37 includes, for example, a microcomputer and a memory 37*a* provided for controlling the outdoor unit 20, and an inverter circuit or the like for controlling the motor 21*m*. Hence, the outdoor-side controller 37 can transmit and receive a control signal to and from each of the indoor-side controllers 47, 57, and 67 of a corresponding one of the indoor units 40, 50, and 60 via the transmission line 80*a*. In this case, each of the indoor-side controllers 47, 57, and 67, the outdoor-side controller 37, and the transmission line 80*a* that connects each of the indoor-side controllers 47, 57, and 67 and the outdoor-side controller 37 constitute a control unit 80 that controls operation of the entire air conditioning apparatus 10.

(1-3) Connection Pipes

The connection pipes 71 and 72 are refrigerant pipes that are constructed on the site when the air conditioning apparatus 10 is installed at an installation location such as a building. The connection pipes 71 and 72 have lengths and pipe diameters that vary depending on the combination of an outdoor unit and an indoor unit and the conditions such as an installation location. Thus, for example, when an air conditioning apparatus is newly installed, filling with a refrigerant is required by an appropriate amount corresponding to the conditions, such as the lengths or pipe diameters of the connection pipes 71 and 72.

(1-4) Control Unit

Figure 2:
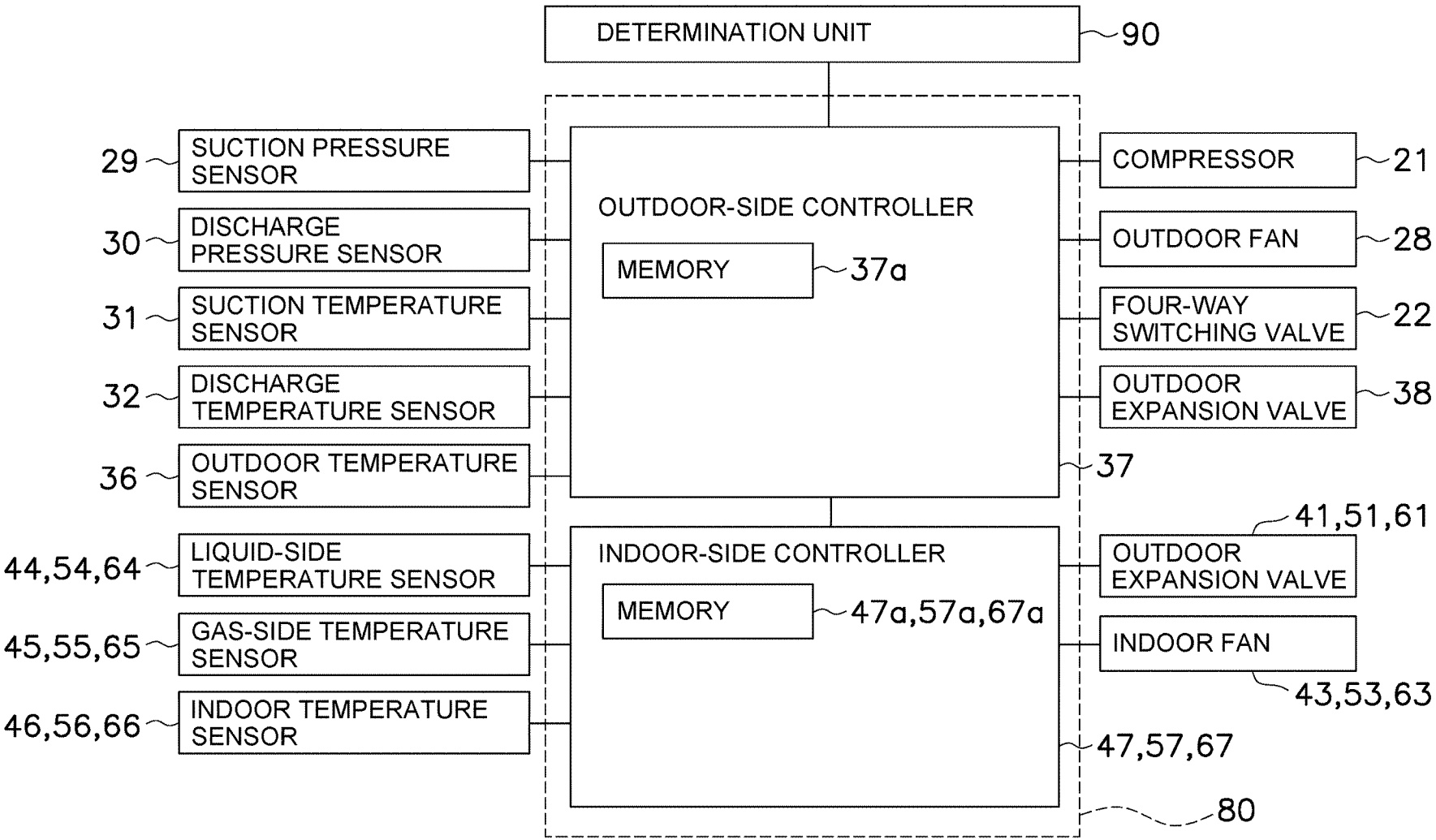
FIG. 2 is a control block diagram of the air conditioning apparatus 10.

As described above, the air conditioning apparatus 10 includes the control unit 80. The control unit 80 controls devices of the air conditioning apparatus 10, and is implemented by cooperation between the outdoor-side controller 37 and each of the indoor-side controllers 47, 57, and 67. As illustrated in FIG. 2, the control unit 80 is connected so as to receive detection signals of the various sensors 29 to 32, 36, 44 to 46, 54 to 56, and 64 to 66. The control unit 80 also controls various devices and valves 21, 22, 28, 38, 41, 43, 51, 53, 61, and 63 on the basis of the detection signals. The memories 37*a*, 47*a*, 57*a*, and 67*a* that constitute the control unit 80 store various pieces of data.

The air conditioning apparatus 10 also includes a determination unit 90. The determination unit 90 is distinguished from the control unit 80 for the convenience of description; however, the determination unit 90 can be implemented as a function of the control unit 80. Alternatively, the determination unit 90 can be implemented by a device having a configuration that differs from the configuration of the control unit 80. The function of the determination unit 90 will be described later.

(2) Operation of Air Conditioning Apparatus

Next, operation of the air conditioning apparatus 10 according to the embodiment is described.

The air conditioning apparatus 10 performs indoor-temperature optimization control on each of the indoor units 40, 50, and 60 to bring an indoor temperature Tr to be closer to a set temperature Ts that is set by a user using an input device such as a remote controller in cooling operation and heating operation described below. In the indoor-temperature optimization control, the opening degrees of the outdoor expansion valve 38 and each of the indoor expansion valves 41, 51, and 61 are adjusted to cause the indoor temperature Tr to be settled at the set temperature Ts.

(2-1) Cooling Operation

In cooling operation, the four-way switching valve 22 is in the state indicated by the solid lines in FIG. 1. That is, the discharge side of the compressor 21 is connected to the gas side of the outdoor heat exchanger 23, and the suction side of the compressor 21 is connected to the gas side of each of the indoor heat exchangers 42, 52, and 62 via the gas-side shutoff valve 27 and the gas-refrigerant connection pipe 72.

In cooling operation, a low-pressure gas refrigerant is sucked to and compressed by the compressor 21 to be a high-pressure gas refrigerant. The high-pressure gas refrigerant is sent to the outdoor heat exchanger 23 via the four-way switching valve 22. The high-pressure gas refrigerant is condensed by exchanging heat with the outdoor air supplied by the outdoor fan 28 to be a high-pressure liquid refrigerant. The high-pressure liquid refrigerant is sent to each of the indoor units 40, 50, and 60 via the liquid-side shutoff valve 26 and the liquid-refrigerant connection pipe 71. In each of the indoor units 40, 50, and 60, the high-pressure liquid refrigerant is decompressed to have a pressure close to the suction pressure of the compressor 21 by a corresponding one of the indoor expansion valves 41, 51, and 61. The refrigerant is evaporated by exchanging heat with the indoor air in each of the indoor heat exchangers 42, 52, and 62 to be the low-pressure gas refrigerant. The low-pressure gas refrigerant is sent to the outdoor unit 20 via the gas-refrigerant connection pipe 72, and flows into the accumulator 24 via the gas-side shutoff valve 27 and the four-way switching valve 22. The low-pressure gas refrigerant flowing into the accumulator 24 is sucked again to the compressor 21.

In the above-described cooling operation, the opening degree of the outdoor expansion valve 38 is adjusted to a full-open state. The opening degree of each of the indoor expansion valves 41, 51, and 61 is adjusted to cause the superheating degree of the refrigerant at the outlet of a corresponding one of the indoor heat exchangers 42, 52, and 62 (that is, the gas side of a corresponding one of the indoor heat exchangers 42, 52, and 62) to be constant at a target superheating degree. The superheating degree of the refrigerant at the outlet of each of the indoor heat exchangers 42, 52, and 62 is detected, for example, by converting the suction pressure of the compressor 21 detected by the suction pressure sensor 29 into a saturation temperature value corresponding to an evaporation temperature Te and subtracting the saturation temperature value of the refrigerant from the refrigerant temperature value detected by a corresponding one of the gas-side temperature sensors 45, 55, and 65. Alternatively, the superheating degree of the refrigerant at the outlet of each of the indoor heat exchangers 42, 52, and 62 may be detected, for example, by providing a temperature sensor that detects the temperature of the refrigerant flowing in each of the indoor heat exchangers 42, 52, and 62, and subtracting a refrigerant temperature value corresponding to an evaporation temperature Te detected by the temperature sensor from the refrigerant temperature value detected by a corresponding one of the gas-side temperature sensors 45, 55, and 65.

(2-2) Heating Operation

In heating operation, the four-way switching valve 22 is in the state indicated by the broken lines in FIG. 1. That is, the discharge side of the compressor 21 is connected to the gas side of each of the indoor heat exchangers 42, 52, and 62 via the gas-side shutoff valve 27 and the gas-refrigerant connection pipe 72, and the suction side of the compressor 21 is connected to the gas side of the outdoor heat exchanger 23.

In heating operation, the low-pressure gas refrigerant is sucked to and compressed by the compressor 21 to be the high-pressure gas refrigerant. The high-pressure gas refrigerant is sent to each of the indoor units 40, 50, and 60 via the four-way switching valve 22, the gas-side shutoff valve 27, and the gas-refrigerant connection pipe 72. In each of the indoor heat exchangers 42, 52, and 62, the high-pressure gas refrigerant is condensed by exchanging heat with the indoor air to be the high-pressure liquid refrigerant. The high-pressure liquid refrigerant is decompressed in accordance with the valve opening degree of each of the indoor expansion valves 41, 51, and 61 when passing through the one of the indoor expansion valves 41, 51, and 61. The refrigerant passing through each of the indoor expansion valves 41, 51, and 61 is sent to the outdoor unit 20 via the liquid-refrigerant connection pipe 71, and is further decompressed via the liquid-side shutoff valve 26 and the outdoor expansion valve 38. Thus, the refrigerant becomes a low-pressure gas-liquid two-phase state refrigerant. The refrigerant flows into the outdoor heat exchanger 23. The low-pressure gas-liquid two-phase state refrigerant flowing into the outdoor heat exchanger 23 is evaporated by exchanging heat with the outdoor air supplied by the outdoor fan 28 to be the low-pressure gas refrigerant. The low-pressure gas refrigerant flows into the accumulator 24 via the four-way switching valve 22. The low-pressure gas refrigerant flowing into the accumulator 24 is sucked again to the compressor 21.

In the above-described heating operation, the control unit 80 performs expansion-valve-relevant control to adjust the opening degree of the outdoor expansion valve 38 on the basis of a representative opening degree of the indoor expansion valves 41, 51, and 61. The control unit 80 employs, as the representative opening degree of the indoor expansion valves 41, 51, and 61, the opening degree of the indoor expansion valve that is the maximum opening degree among the opening degrees of the indoor expansion valves 41, 51, and 61. In the air conditioning apparatus 10 of the embodiment, the control unit 80 adjusts the opening degree of the outdoor expansion valve 38 to cause the decompression amount by the indoor expansion valve having the maximum opening degree among the opening degrees of the indoor expansion valves 41, 51, and 61 to be at a certain degree to maintain the liquid phase even after the decompression, for example, 0.2 MPa (a target predetermined value of a valve opening pulse set in correspondence with the decompression amount of 0.2 MPa). At this time, the opening degree of each of the indoor expansion valves 41, 51, and 61 is adjusted to cause a subcooling degree SC of the refrigerant at the outlet of a corresponding one of the indoor heat exchangers 42, 52, and 62 to be constant at a target subcooling degree SCt.

(3) Detection of Refrigerant Leak (Refrigeration Cycle of Heating Operation)

The air conditioning apparatus 10 according to the embodiment has a function of determining whether the refrigerant amount is appropriate in the refrigeration cycle of the above-described heating operation. Thus, the air conditioning apparatus 10 can detect a refrigerant leak.

When it is determined whether the refrigerant amount is appropriate, the control unit 80 sets each of the opening degrees of the indoor expansion valves 41, 51, and 61 to a permissible maximum opening degree and then controls the opening degree of the outdoor expansion valve 38. Note that the "permissible maximum opening degree" is the maximum opening degree permissible when the air conditioning apparatus 10 is appropriately operated, and is a value that is set per indoor expansion valve in accordance with the combination of a plurality of indoor units and an outdoor unit. The values are stored in a memory or the like in advance. Moreover, the control unit 80 controls the opening degree of the outdoor expansion valve 38 in accordance with the representative opening degree of each of the indoor expansion valves 41, 51, and 61.

Figure 3:
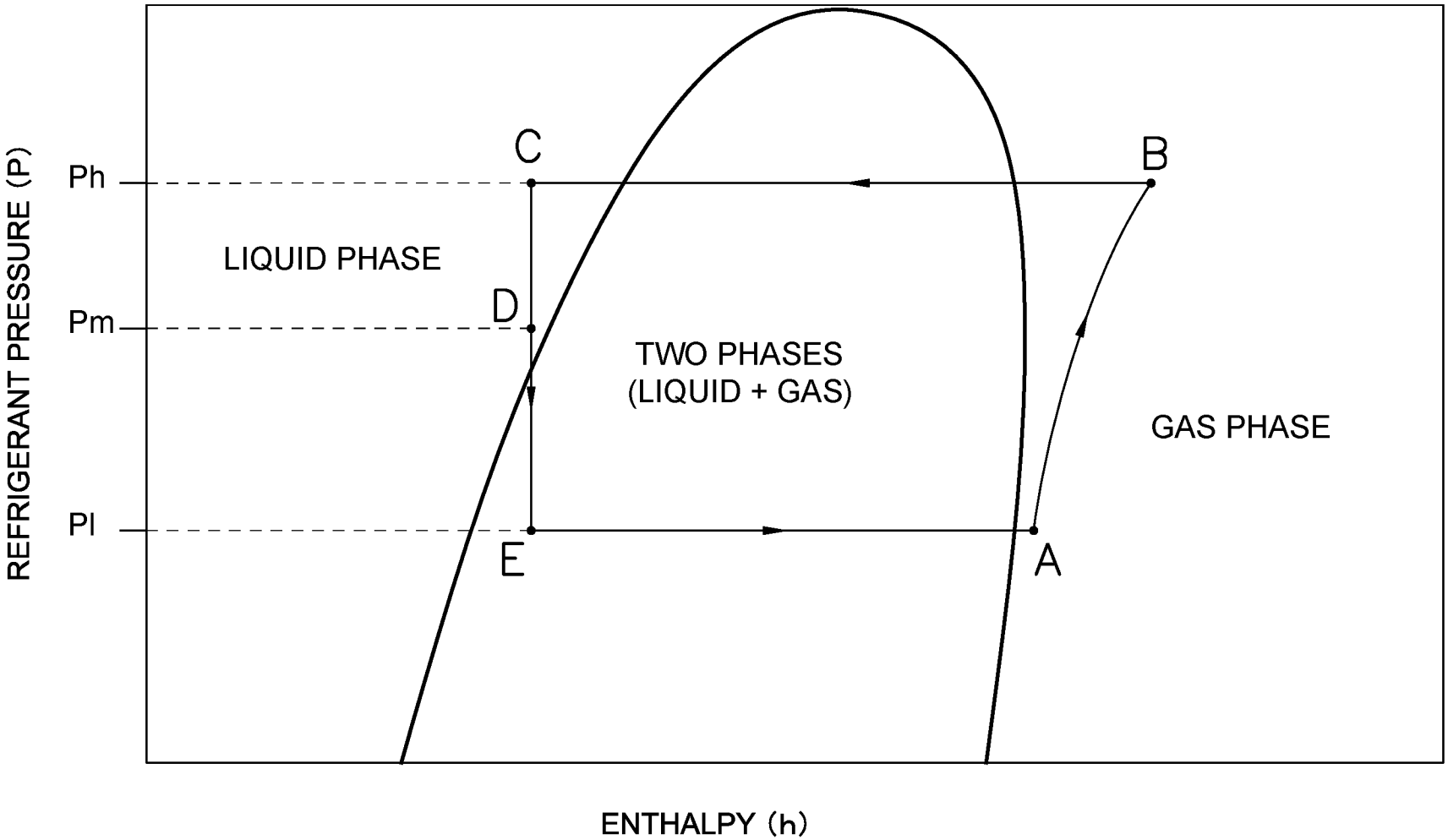
FIG. 3 is a p-h diagram (Mollier diagram) of a refrigeration cycle.

In this case, the state of the refrigerant in the refrigeration cycle of the heating operation shifts like the p-h diagram (Mollier diagram) as illustrated in FIG. 3. Points indicated by A, B, C, D, and E in FIG. 3 respectively represent the states of the refrigerant corresponding to points indicated by A, B, C, D, and E in FIG. 1. In the refrigerant circuit 11, the refrigerant is compressed by the compressor 21 to be at a high temperature and a high pressure Ph (A to B). The heat of the gas refrigerant at high pressure Ph is dissipated by each of the indoor heat exchangers 42, 52, and 62 that functions as a condenser to be the liquid refrigerant at a low temperature and the high pressure Ph (B to C). The refrigerant whose heat has been dissipated by each of the indoor heat exchangers 42, 52, and 62 is decompressed to be at an intermediate pressure Pm from the high pressure Ph by a corresponding one of the indoor expansion valves 41, 51, and 61 (C to D). In the state of the point D, the refrigerant is in the liquid phase state. The refrigerant decompressed to be at the intermediate pressure Pm flows into the outdoor unit 20, is decompressed by the outdoor expansion valve 38 to be from the intermediate pressure Pm to a low pressure Pl, and becomes the gas-liquid two-phase state (D to E). The refrigerant that has become the gas-liquid two-phase state absorbs heat in the outdoor heat exchanger 23 that functions as an evaporator, is evaporated, and returns to the compressor 21 (E to A).

When it is determined whether the refrigerant amount is appropriate, the control unit 80 always collect the measurement value of the temperature measured by each of the liquid-side temperature sensors 44, 54, and 64. The determination unit compares the measurement value of the temperature collected by the control unit 80 to a predetermined threshold, and determines whether the refrigerant amount in the refrigerant circuit 11 is appropriate. The determination unit 90 determines that a refrigerant leak does not occur when the refrigerant amount is appropriate (refrigerant leak=false), and determines that a refrigerant leak occurs when the refrigerant amount is not appropriate (refrigerant leak=true).

Figure 4A:
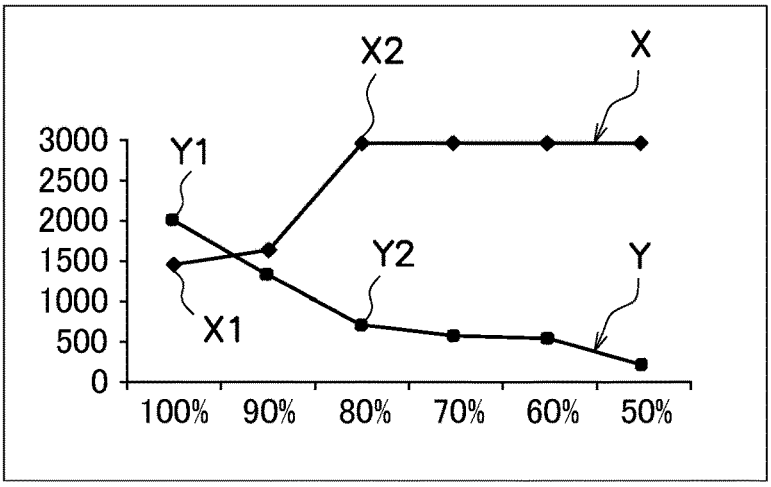
FIG. 4A is a graph illustrating the relationship between valve opening degrees of indoor expansion valves 41, 51, and 61 and an outdoor expansion valve 38 and a refrigerant filling amount.
Figure 4B:
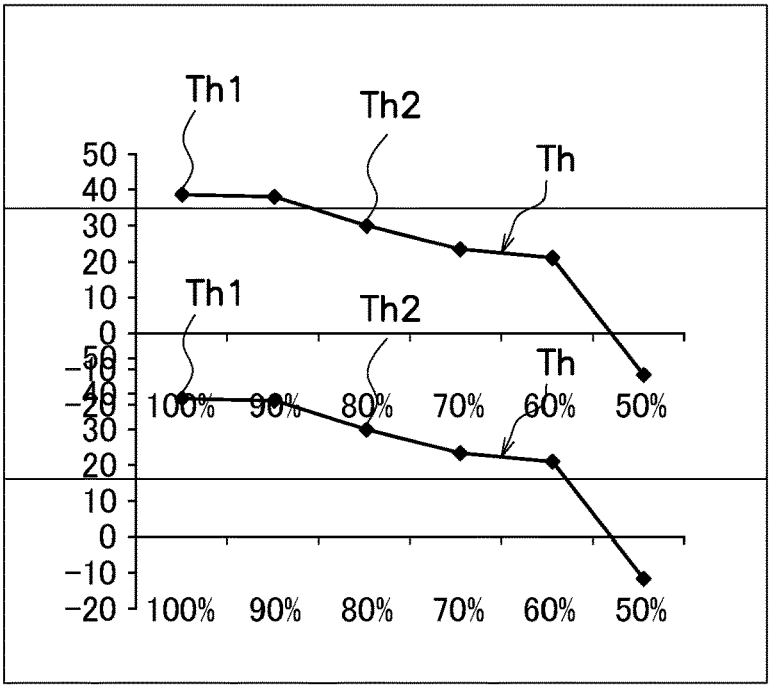
FIG. 4B is a graph illustrating the relationship between a refrigerant temperature and a refrigerant filling amount.

Specifically, the air conditioning apparatus 10 according to the embodiment is designed such that the refrigerant is excessive more in heating operation than the refrigerant in cooling operation. Thus, when a refrigerant leak occurs in heating operation, the excessive refrigerant of the accumulator 24 decreases. As illustrated in FIG. 4A, in the air conditioning apparatus 10 in normal heating operation, an opening degree X of the outdoor expansion valve 38 and a representative opening degree Y of each of the indoor expansion valves 41, 51, and 61 are in open states with predetermined opening degrees (X1, Y1). In this case, when the excessive refrigerant of the accumulator 24 decreases, the outlet (liquid side) of each of the indoor heat exchangers 42, 52, and 62 becomes a dry state. In heating operation, the outside air temperature is higher than the evaporation temperature Te, and hence the refrigerant is superheated. In response to this, the opening degree X of the outdoor expansion valve 38 is controlled to be open (X1 to X2). When the opening degree X of the outdoor expansion valve 38 is controlled to be open, the outlet of each of the indoor heat exchangers 42, 52, and 62 starts to become a humid state. In response to this, the representative opening degree Y of the indoor expansion valves 41, 51, and 61 is controlled to be closed (Y1 to Y2). Consequently, the opening degree ratio of the opening degree X of the outdoor expansion valve 38 to the representative opening degree Y of each of the indoor expansion valves 41, 51, and 61 largely changes. Moreover, due to this, the intermediate pressure Pm largely decreases. In other words, in the air conditioning apparatus 10 according to the embodiment, when a refrigerant leak occurs, the value of the intermediate pressure Pm largely changes. The value of the intermediate pressure Pm corresponds to a refrigerant temperature Th of the liquid-refrigerant connection pipe 71 between the indoor expansion valves 41, 51, and 61 and the outdoor expansion valve 38. As illustrated in FIG. 4B, the refrigerant temperature Th in the liquid-refrigerant connection pipe 71 largely changes (Th1 to Th2). Referring to FIG. 4A, the vertical axis indicates a valve opening degree, and the horizontal axis indicates a refrigerant filling rate. Referring to FIG. 4B, the vertical axis indicates a temperature, and the horizontal axis indicates a refrigerant filling rate.

Based on such findings, in the air conditioning apparatus 10 according to the embodiment, the determination unit 90 determines whether a refrigerant leak occurs on the basis of the temperatures measured by the liquid-side temperature sensors 44, 54, and 64 disposed downstream of the indoor expansion valves 41, 51, and 61 in the direction in which the refrigerant flows in heating operation.

(4) Features (4-1)

As described above, the air conditioning apparatus 10 according to the embodiment includes the refrigerant circuit 11 in which the plurality of indoor units 40, 50, and 60 respectively including the indoor heat exchangers 42, 52, and 62 and the indoor expansion valves 41, 51, and 61 are connected to the outdoor unit 20 including the outdoor expansion valve 38 via the liquid-refrigerant connection pipe 71 and the gas-refrigerant connection pipe 72. Moreover, the air conditioning apparatus 10 individually controls each of the indoor units 40, 50, and 60 to operate or stop.

In the air conditioning apparatus 10, when at least one of the indoor heat exchangers 42, 52, and 62 functions as a condenser (radiator), the control unit 80 sets the opening degrees of the indoor expansion valves 41, 51, and 61 to the permissible maximum opening degrees (predetermined opening degrees) and then controls the opening degree of the outdoor expansion valve 38.

In the air conditioning apparatus 10, the determination unit 90 determines whether the refrigerant amount in the refrigerant circuit 11 is appropriate on the basis of an amount of change in temperature between the indoor expansion valves 41, 51, and 61 and the outdoor expansion valve 38. Accordingly, it can be highly accurately determined whether the refrigerant amount in the refrigerant circuit 11 is appropriate.

More specifically, in the air conditioning apparatus 10 according to the embodiment, a change in state of the refrigerant between the indoor expansion valves 41, 51, and 61 and the outdoor expansion valve 38 is reflected on the measurement value of the temperature. Thus, by detecting whether the amount of change in the temperature between the indoor expansion valves 41, 51, and 61 and the outdoor expansion valve 38 falls within a predetermined range, it can be highly accurately determined whether the refrigerant amount in the refrigerant circuit 11 is appropriate.

Since a refrigerant leak can be detected from the display of the measurement value of the temperature as described above, the determination method is more convenient than another determination method.

Moreover, in combination with a method of detecting a refrigerant leak in the refrigeration cycle in cooling operation, the refrigerant amount can be monitored throughout the year. The discharge amount of the refrigerant can be markedly reduced in total.

(4-2)

Moreover, in the air conditioning apparatus 10, the outdoor unit 20 includes the four-way switching valve 22 (switching mechanism) and the accumulator 24 (container). In this case, the accumulator 24 (container) stores an excessive refrigerant that represents a difference between the refrigerant circulating in the refrigerant circuit 11 when at least one of the indoor heat exchangers 42, 52, and 62 functions as a condenser (radiator) and the refrigerant circulating in the refrigerant circuit 11 when at least one of the indoor heat exchangers 42, 52, and 62 functions as an evaporator. Accordingly, the air conditioning apparatus 10 with high annual performance factor (APF) can be provided. Note that since the excessive refrigerant is stored in the accumulator 24, liquid compression in the compressor 21 can be prevented from occurring.

(4-3)

In the air conditioning apparatus 10 according to the embodiment, the determination unit 90 determines whether the refrigerant amount in the refrigerant circuit 11 is appropriate on the basis of an amount of change corresponding to a change in state of the refrigerant between the indoor expansion valves 41, 51, and 61 and the outdoor expansion valve 38. Specifically, the determination unit 90 determines whether the refrigerant amount in the refrigerant circuit 11 is appropriate on the basis of the amounts of change in the temperatures measured by the liquid-side temperature sensors 44, 54, and 64 respectively disposed in the indoor units 40, 50, and 60, as the amount of change corresponding to the change in state of the refrigerant between the indoor expansion valves 41, 51, and 61 and the outdoor expansion valve 38.

As described above, the amount of change in the temperature of the liquid-refrigerant connection pipe 71 between each of the indoor expansion valves 41, 51, and 61 and the outdoor expansion valve 38 corresponds to the amount of refrigerant leak. Thus, the air conditioning apparatus 10 according to the embodiment can highly accurately determine whether the refrigerant amount in the refrigerant circuit 11 is appropriate.

(5) Modifications (5-1) Modification 1A

In the above description, the determination unit 90 determines whether the refrigerant amount in the refrigerant circuit 11 is appropriate on the basis of the amounts of change in the temperatures measured by the liquid-side temperature sensors 44, 54, and 64 respectively disposed in the indoor units 40, 50, and 60 as the amount of change corresponding to the change in state of the refrigerant between the indoor expansion valves 41, 51, and 61 and the outdoor expansion valve 38. However, the air conditioning apparatus 10 according to the embodiment is not limited thereto. In the air conditioning apparatus 10 according to the embodiment, any physical amount can be employed as long as the amount is the amount of change corresponding to the change in state of the refrigerant between the indoor expansion valves 41, 51, and 61 and the outdoor expansion valve 38. For example, the determination unit 90 can determine whether the refrigerant amount in the refrigerant circuit 11 is appropriate by using the opening degree ratio of the opening degrees of the indoor expansion valves 41, 51, and 61 to the opening degree of the outdoor expansion valve 38 as the amount of change corresponding to the change in state of the refrigerant between the indoor expansion valves 41, 51, and 61 and the outdoor expansion valve 38.

(5-2) Modification 1B

In the above description, the determination unit 90 determines whether the refrigerant amount in the refrigerant circuit 11 is appropriate on the basis of the amounts of change in the temperatures measured by the liquid-side temperature sensors 44, 54, and 64 respectively disposed in the indoor units 40, 50, and 60 as the amount of change corresponding to the change in state of the refrigerant between the indoor expansion valves 41, 51, and 61 and the outdoor expansion valve 38. However, the air conditioning apparatus 10 according to the embodiment is not limited thereto. In the air conditioning apparatus 10 according to the embodiment, any configuration can be employed in which the determination unit 90 determines the amount of change corresponding to the change in state of the refrigerant on the basis of the temperature of the liquid-refrigerant connection pipe 71 between the indoor expansion valves 41, 51, and 61 and the outdoor expansion valve 38.

Figure 5:
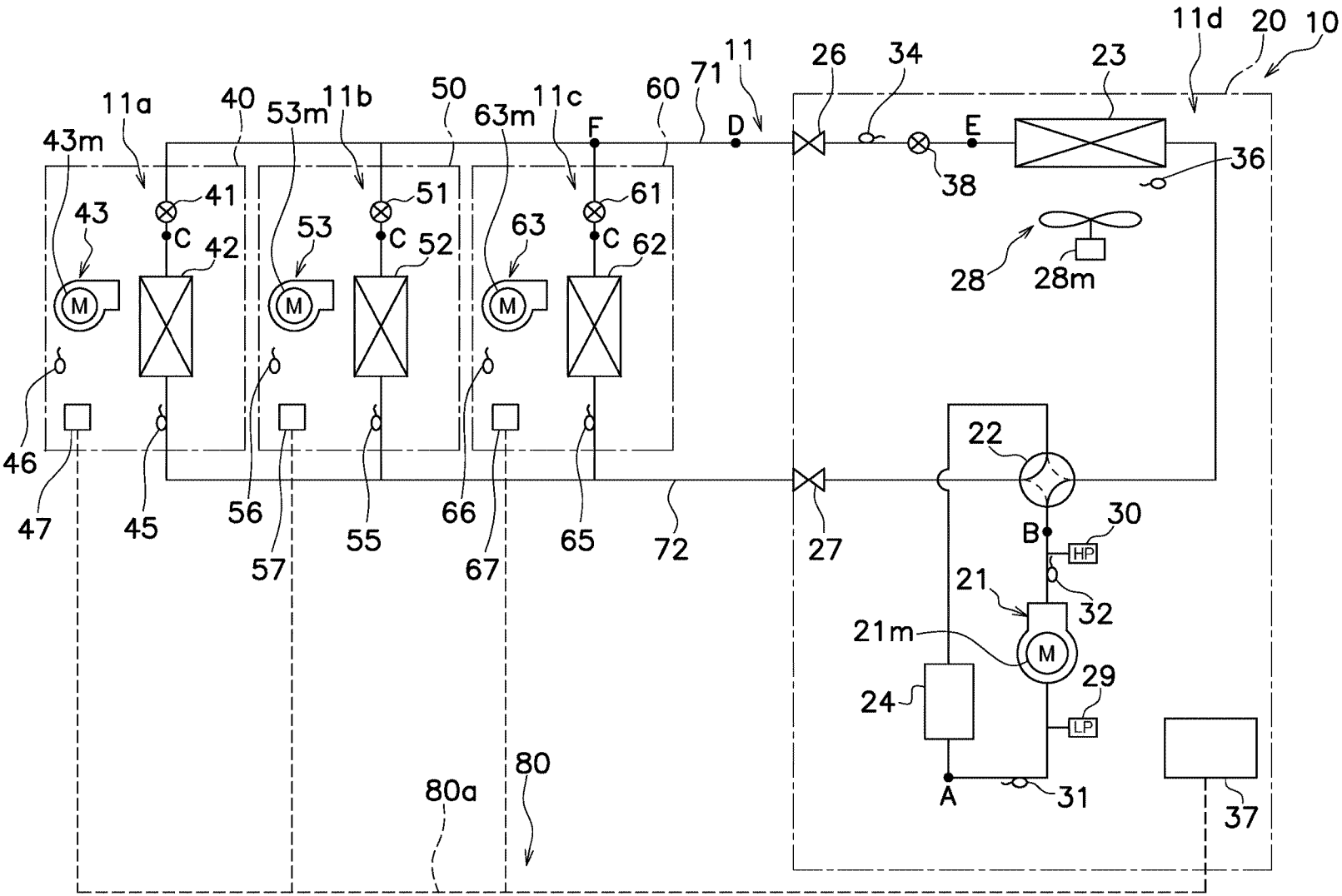
FIG. 5 is a schematic configuration diagram of an air conditioning apparatus 10 according to Modification 1B.

For example, as illustrated in FIG. 5, the outdoor unit 20 may have a configuration including a liquid-side temperature sensor 34 located upstream of the outdoor expansion valve 38 in the direction in which the refrigerant flows in heating operation. In this case, the determination unit 90 determines whether the refrigerant amount in the refrigerant circuit 11 is appropriate on the basis of the amount of change in the temperature measured by the liquid-side temperature sensor 34 disposed in the outdoor unit 20, as the amount of change corresponding to the change in state of the refrigerant between the indoor expansion valves 41, 51, and 61 and the outdoor expansion valve 38. Accordingly, it can be highly accurately determined whether the refrigerant amount in the refrigerant circuit 11 is appropriate using the simple configuration.

Figure 6:
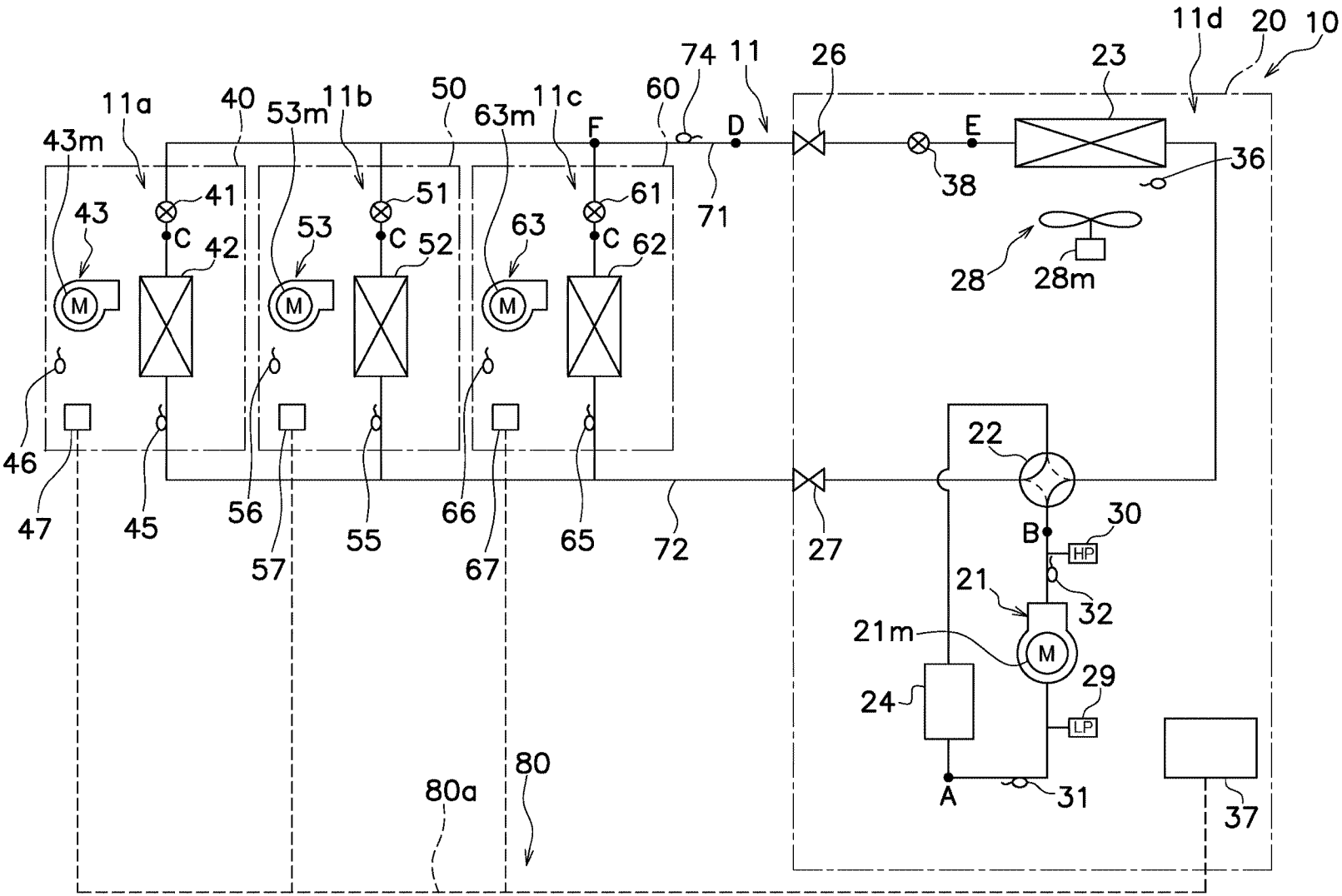
FIG. 6 is a schematic configuration diagram of the air conditioning apparatus 10 according to Modification 1B.

Furthermore, as illustrated in FIG. 6, a configuration may be employed in which a liquid-side temperature sensor 74 is provided at a position located downstream of a position (a point F in FIG. 6) at which pipes extending from the plurality of indoor expansion valves 41, 51, and 61 are joined, in the direction in which the refrigerant flows in heating operation. In this case, the determination unit 90 determines whether the refrigerant amount in the refrigerant circuit 11 is appropriate on the basis of the amount of change in the temperature measured by the liquid-side temperature sensor 74, as the amount of change corresponding to the change in state of the refrigerant between the indoor expansion valves 41, 51, and 61 and the outdoor expansion valve 38. The measurement value of the temperature measured by the liquid-side temperature sensor 74 more sensitively reacts to the change in state between the indoor expansion valves 41, 51, and 61 and the outdoor expansion valve 38 than the measurement values of the temperatures measured by the liquid-side temperature sensors 44, 54, and 64 respectively provided in the indoor units 40, 50, and 60. Thus, it can be highly accurately determined whether the refrigerant amount in the refrigerant circuit 11 is appropriate.

The liquid-refrigerant connection pipe 71 used for the air conditioning apparatus 10 may be partly or entirely provided with and integrated with the above-described liquid-side temperature sensor 74. With such a configuration, the connection pipe for highly accurately determining whether the refrigerant amount in the refrigerant circuit 11 is appropriate can be provided in a replaceable manner.

(5-3) Modification 1D

In the above description, the control unit 80 adjusts the opening degree of each of the indoor expansion valves 41, 51, and 61 to the permissible maximum opening degree as the predetermined opening degree. However, the air conditioning apparatus 10 according to the embodiment is not limited thereto. In the air conditioning apparatus 10 according to the embodiment, the control unit 80 can employ any configuration that makes the opening degree of each of the indoor expansion valves 41, 51, and 61 constant.

(5-4) Modification 1E

In the above description, the determination unit 90 determines whether the refrigerant amount is appropriate. However, the air conditioning apparatus 10 according to the embodiment is not limited thereto. For example, in the air conditioning apparatus 10 according to the embodiment, the determination unit 90 may calculate the amount of leaking refrigerant by comparing the amount of change corresponding to the change in state of the refrigerant between the indoor expansion valves 41, 51, and 61 and the outdoor expansion valve 38 (the amount of change in temperature, the opening degree ratio, or the like) to multiple thresholds.

(5-5) Modification 1F

In the above description, the determination unit 90 detects a leak of the refrigerant. However, the air conditioning apparatus 10 according to the embodiment is not limited thereto. For example, in the air conditioning apparatus 10 according to the embodiment, the determination unit 90 may detect excessive filling of the refrigerant. Furthermore, the amount of excessive filling of the refrigerant may be calculated.

(5-6) Modification 1G

Figure 7:
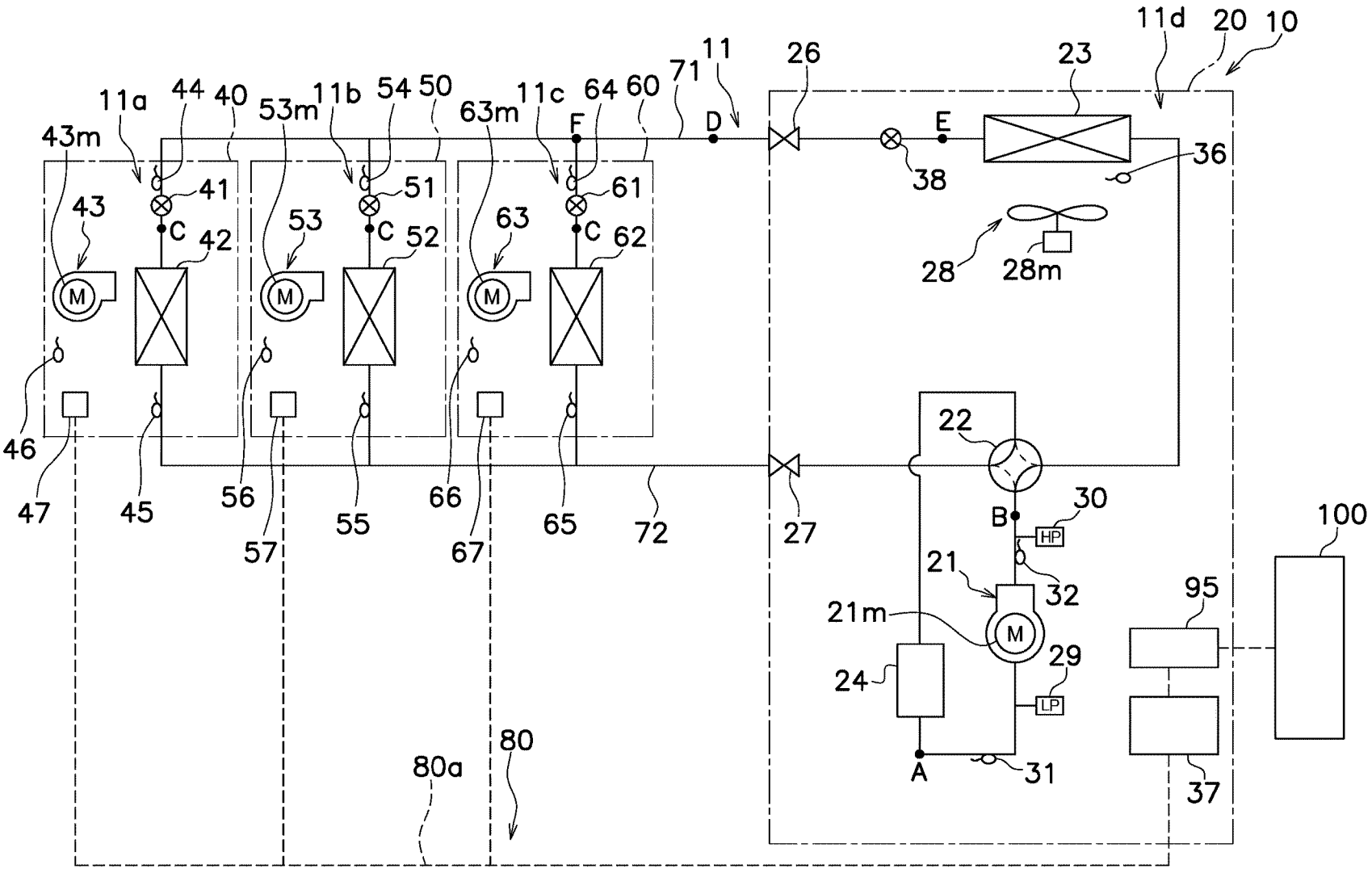
FIG. 7 is a schematic configuration diagram of an air conditioning apparatus 10 according to Modification 1G.

In the air conditioning apparatus 10, an external management device 100 may have the function of the determination unit 90. In this case, the air conditioning apparatus 10 includes a communication unit 95 as illustrated in FIG. 7. Moreover, the management device 100 is communicable with the air conditioning apparatus 10.

In this configuration, the communication unit 95 transmits the amount of change corresponding to the change in state of the refrigerant between each of the indoor expansion valves 41, 51, and 61 and the outdoor expansion valve 38 to the management device 100. Note that the communication unit 95 may use either of wireless or wired communication method.

The management device 100 acquires the amount of change corresponding to the change in state of the refrigerant between each of the indoor expansion valves 41, 51, and 61 and the outdoor expansion valve 38, and determines whether the refrigerant amount in the refrigerant circuit 11 is appropriate on the basis of the acquired amount of change.

With this configuration, calculation load of the air conditioning apparatus 10 can be reduced, and an administrator of the management device 100 can manage whether the refrigerant amount in the refrigerant circuit 11 is appropriate.

Second Embodiment (6) Air Conditioning Apparatus 10*a*

(6-1) Subcooling Flow Path

Figure 8:
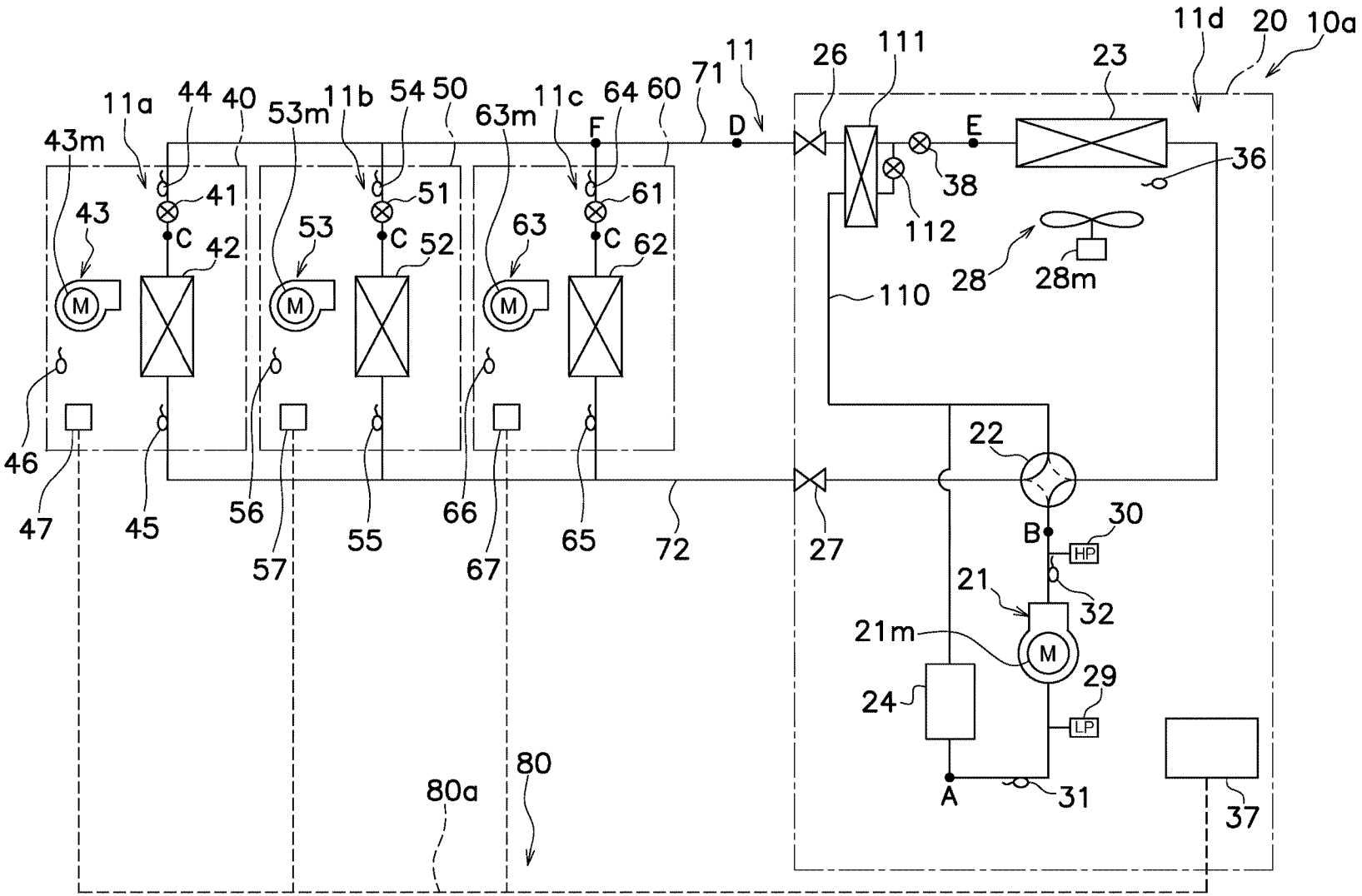
FIG. 8 is a schematic configuration diagram of an air conditioning apparatus 10*a* according to a second embodiment.

FIG. 8 is a refrigerant circuit diagram of an air conditioning apparatus 10*a* according to a second embodiment. The air conditioning apparatus 10*a* of the second embodiment includes all configurations of the air conditioning apparatus 10 of the first embodiment, and further includes a branch pipe 110, a subcooling expansion valve (branch-pipe expansion mechanism) 112, and a subcooling heat exchanger 111. In other words, the branch pipe 110, the subcooling expansion valve 112, and the subcooling heat exchanger 111 constitute a subcooling flow path.

The branch pipe 110 connects the connection pipe between the outdoor expansion mechanism 38 and the liquid-side shutoff valve 26 to the pipe between the four-way switching valve (switching mechanism) 22 and the accumulator (container) 24. The subcooling expansion valve 112 is disposed in the branch pipe 110 on the side close to the connection pipe between the outdoor expansion mechanism 38 and the liquid-side shutoff valve 26. The subcooling heat exchanger 111 is disposed such that the refrigerant located downstream of the subcooling expansion valve 112 in the branch pipe 110 exchanges heat with the refrigerant flowing in the connection pipe between the outdoor expansion mechanism 38 and the liquid-side shutoff valve 26. In the subcooling heat exchanger 111, the refrigerant entering the branch pipe 110 and decompressed by the subcooling expansion valve 112 cools the refrigerant flowing in the connection pipe.

Next, the role of the subcooling flow path of the embodiment in heating operation is described.

In the air conditioning apparatus 1*a* of the embodiment, the subcooling expansion valve 112 is in a slightly open state in heating operation. The subcooling flow path is used to decrease the pressure (intermediate pressure) of the connection pipe between the outdoor expansion mechanism 38 and the liquid-side shutoff valve 26 when the intermediate pressure is abnormally high pressure. When the intermediate pressure is abnormally high, the opening degree of the subcooling expansion valve 112 is increased to decrease the intermediate pressure.

Note that, in the embodiment, when the opening degree of the subcooling expansion valve 112 is 0 or when the subcooling expansion valve 112 is slightly open, the refrigerant circuit is the same or substantially the same as that of the first embodiment. Thus, the content described in the first embodiment is effective also in the second embodiment.

(6-2) Refrigerant Leak Indication Value

Next, a refrigerant leak indication value is described using actual experimental data. The refrigerant leak indication value is an index of an amount of change corresponding to a change in state of the refrigerant with the intermediate pressure.

The refrigerant leak indication value is a value of (intermediate-pressure correspondence value−low-pressure correspondence value)/(high-pressure correspondence value−low-pressure correspondence value).

In this case, the pressure correspondence value may be a pressure or a physical property value corresponding to the pressure. The physical property value is representatively a temperature.

Moreover, the high pressure is a pressure of the refrigerant discharged from the compressor. The low pressure is a pressure of the refrigerant before the refrigerant is sucked to the compressor. The intermediate pressure is a pressure of the connection pipe between the indoor expansion mechanism and the outdoor expansion mechanism.

Moreover, in this case, the value used for the pressure correspondence value is a measurement value of temperature. The high-pressure correspondence value is an indoor-heat-exchanger temperature. The low-pressure correspondence value is an outdoor-heat-exchanger temperature. Moreover, the intermediate-pressure correspondence value is the mean value of temperatures measured by the liquid-side temperature sensors 44, 54, and 64 respectively disposed in the indoor units 40, 50, and 60.

Figure 9A:
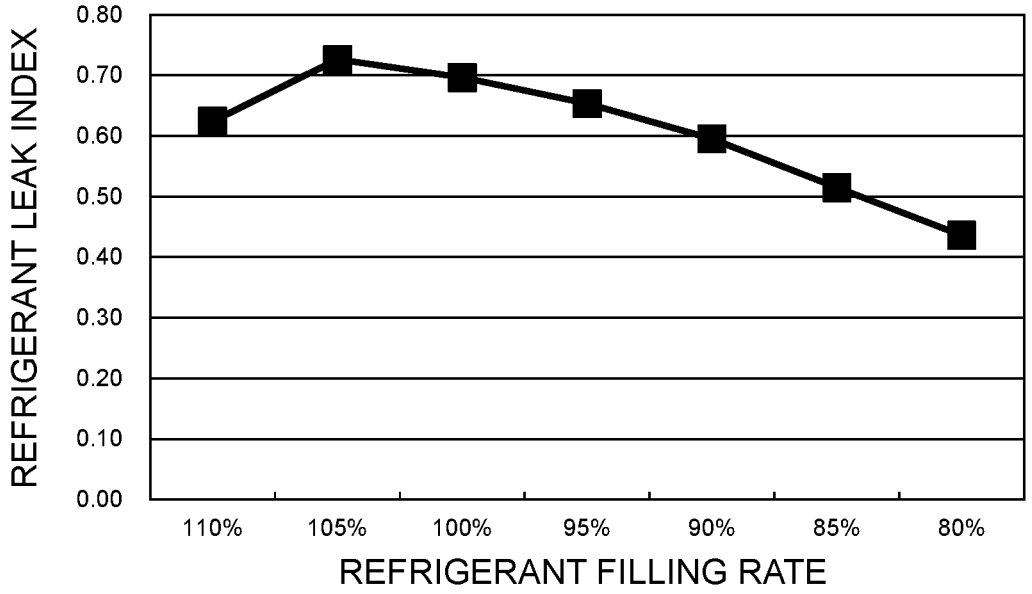
FIG. 9A is a graph illustrating the relationship between a refrigerant leak index and a refrigerant filling amount.

FIG. 9A illustrates measurement data of a refrigerant leak indication value. Experimental conditions in FIGS. 9A and 9B are as follows.

The air conditioning operation is heating operation. Setting is made such that the outside air temperature is 10° C. and the indoor temperature is 20° C. The three indoor units 40, 50, and 60 are connected to the one outdoor unit 20. Two of the three indoor units are in heating operation and remaining one is stopped.

In FIG. 9A, the refrigerant filling rate is changed and the change in refrigerant leak index is measured. When the refrigerant filling rate is an initial appropriate filling amount (refrigerant filling rate of 100%), the refrigerant leak index is 0.7. As the refrigerant filling rate decreases from 100% to 80%, the refrigerant filling index decreases from 0.7 to 0.44. By acquiring such data in advance and acquiring refrigerant leak index data in heating operation, it can be determined whether the refrigerant amount in the refrigerant circuit is appropriate.

Figure 9B:
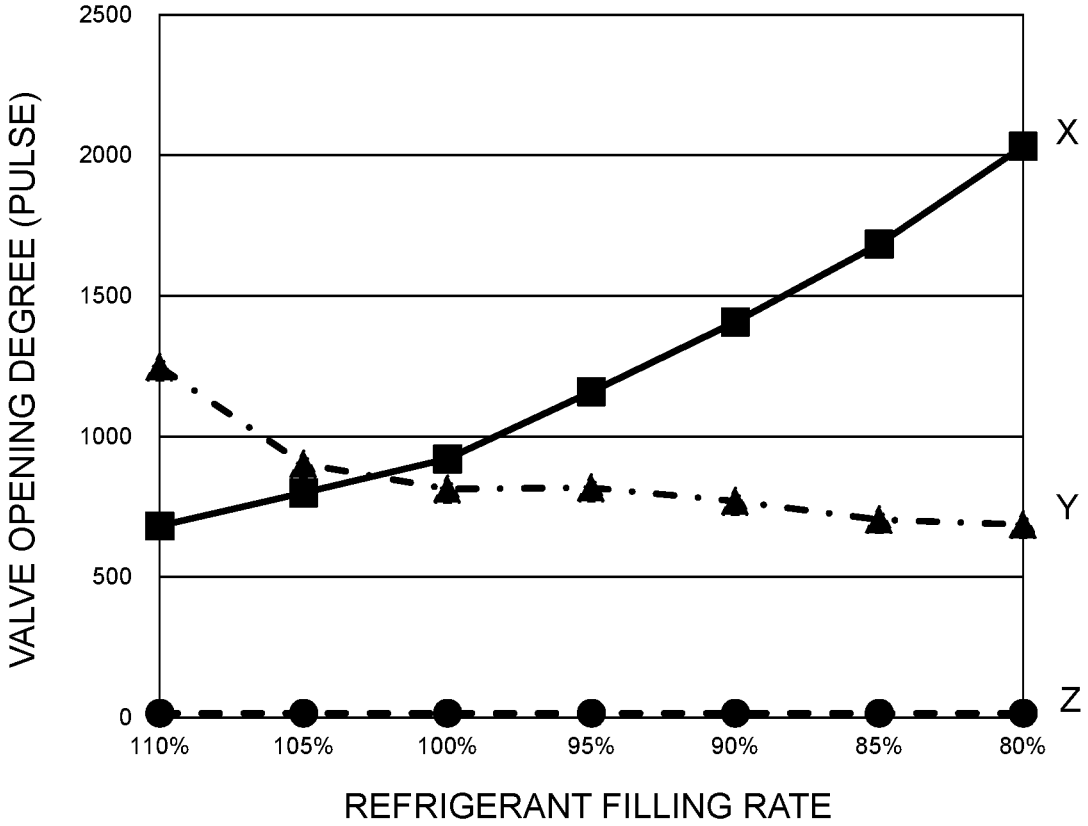
FIG. 9B is a graph illustrating the relationship among a valve opening degree X of indoor expansion valves 41, 51, and 61, a representative opening degree Y of an outdoor expansion valve 38, a valve opening degree Z of a subcooling expansion valve 112, and a refrigerant filling amount.

Moreover, FIG. 9B indicates the opening degree X of the outdoor expansion valve 38, the representative opening degree Y of the indoor expansion valves 41, 51, and 61, and the opening degree of the subcooling expansion valve 112 when the refrigerant filling rate is changed similarly to FIG. 9A. The representative opening degree Y of the indoor expansion valves 41, 51, and 61 is the mean opening degree of the indoor expansion valves 41 and 51 of the two indoor units 40 and 50 in heating operation. The opening degree of the subcooling expansion valve 112 is about 16 pulses representing a slightly open state and is stable. As the refrigerant filling rate decreases from 100% to 80%, the opening degree X of the outdoor expansion valve 38 increases from 921 pulses to 2032 pulses, and the representative opening degree Y of the indoor expansion valves 41, 51, and 61 decreases from 813 pulses to 687 pulses.

As understood from FIG. 9B, it can be determined whether the refrigerant amount in the refrigerant circuit is appropriate using the opening degree X of the outdoor expansion valve 38, the value of the representative opening degree Y of the indoor expansion valves 41, 51, and 61, or the ratio of the opening degree X to the opening degree Y as an index of the amount of change.

Moreover, FIGS. 9A and 9B can be described as follows. When the refrigerant filling amount decreases in heating operation like when the refrigerant leaks, the excessive refrigerant of the accumulator decreases, and the outlet of the outdoor heat exchanger becomes a dry state. At that time, since the outside air temperature is higher than the evaporation temperature, the superheating degree tends to increase. To suppress the increase in the superheating degree, the opening degree of the outdoor expansion valve 38 increases. When the opening degree of the outdoor expansion valve 38 increases, the high pressure decreases accordingly, the outlet of the indoor heat exchanger starts becoming a humid state, and the indoor expansion valve starts closing. As described above, since the refrigerant amount decreases, the opening degree of the outdoor expansion valve increases, and the opening degree of the indoor expansion valve decreases. Thus, the intermediate pressure decreases. Accordingly, the refrigerant leak indication value also decreases.

(7) Modification of Second Embodiment (7-1) Modification 2A

Figure 10:
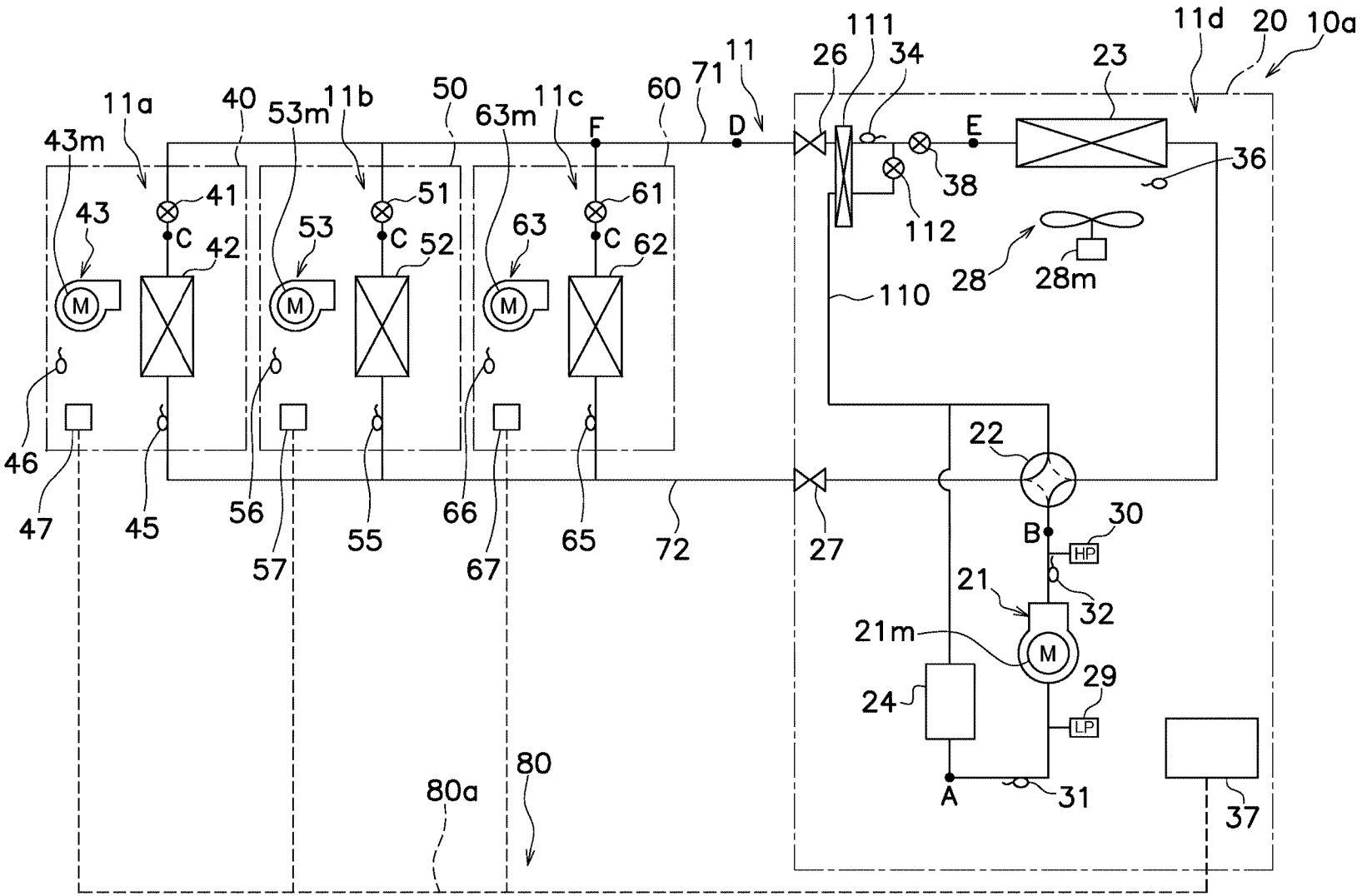
FIG. 10 is a schematic configuration diagram of an air conditioning apparatus 10*a* according to Modification 2A.

In the calculation of the refrigerant leak index of the second embodiment, the value used for the intermediate-pressure correspondence value is the mean value of the temperatures measured by the liquid-side temperature sensors 44, 54, and 64 respectively disposed in the indoor units 40, 50, and 60. In Modification 2A, as illustrated in FIG. 10, the value used for the intermediate-pressure correspondence value is the temperature measured by the liquid-side temperature sensor 34 disposed at the connection pipe between the outdoor expansion mechanism 38 and the liquid-side shutoff valve 26. Referring to FIG. 10, the liquid-side temperature sensor 34 is disposed at the connection pipe between the subcooling heat exchanger 111 and the outdoor expansion valve 38. The other configurations are similar to those of the second embodiment.

(7-2) Modification 2B

Figure 11:
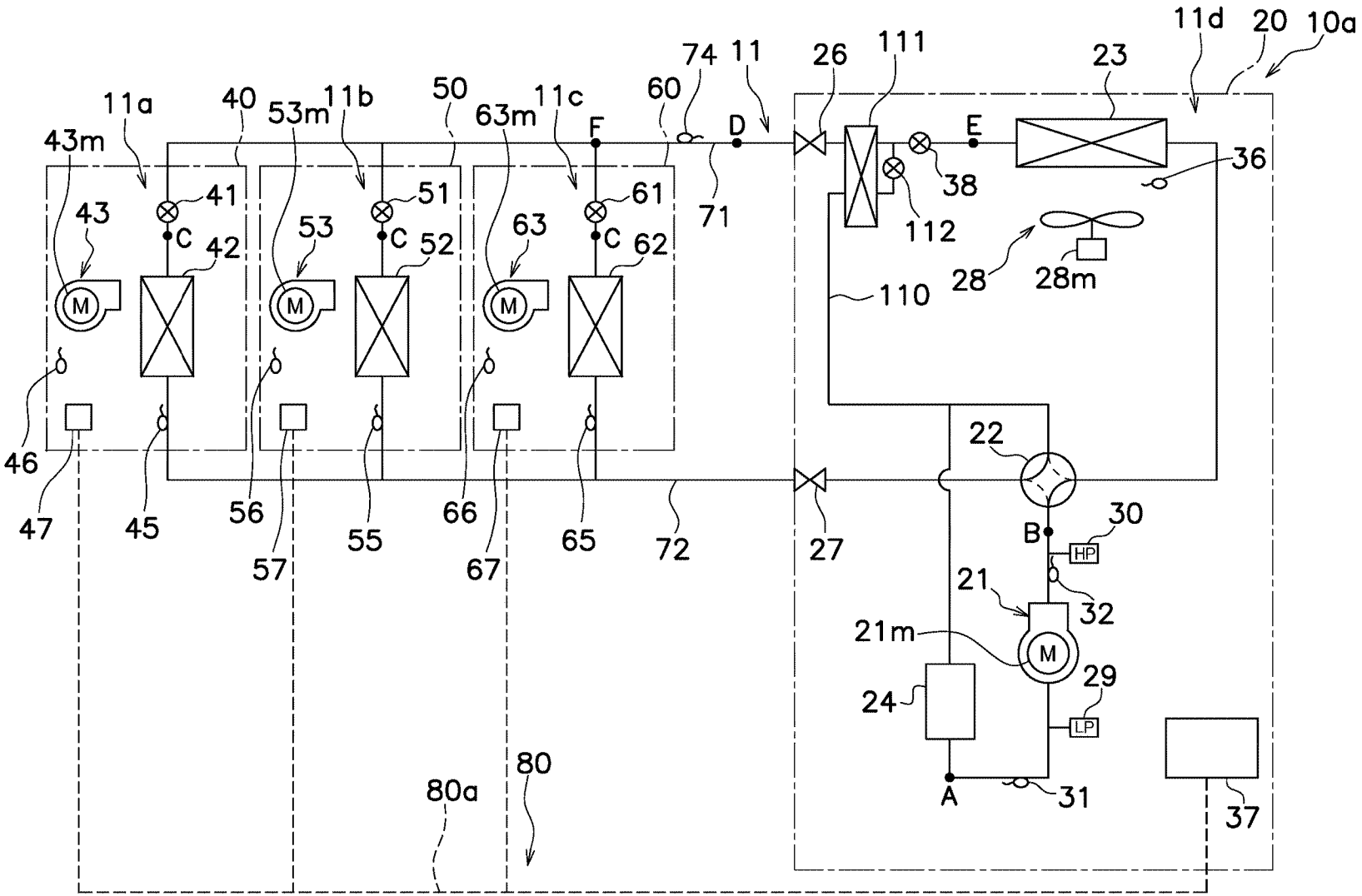
FIG. 11 is a schematic configuration diagram of an air conditioning apparatus 10*a* according to Modification 2B.

In the calculation of the refrigerant leak index of the second embodiment, the value used for the intermediate-pressure correspondence value is the mean value of the temperatures measured by the liquid-side temperature sensors 44, 54, and 64 respectively disposed in the indoor units 40, 50, and 60. In Modification 2B, as illustrated in FIG. 11, the value used for the intermediate-pressure correspondence value is the temperature measured by the liquid-side temperature sensor 74 disposed at a position located downstream of a position (a point F in FIG. 11) at which pipes extending from the plurality of indoor expansion valves 41, 51, and 61 are joined, in the direction in which the refrigerant flows in heating operation. The other configurations are similar to those of the second embodiment.

(7-3) Modification 2C

In the above description, the determination unit 90 determines whether the refrigerant amount is appropriate. However, the air conditioning apparatus 10 according to the embodiment is not limited thereto. For example, in the air conditioning apparatus 10 according to the embodiment, the determination unit 90 may calculate the amount of leaking refrigerant by comparing the amount of change corresponding to the change in state of the refrigerant between the indoor expansion valves 41, 51, and 61 and the outdoor expansion valve 38 (the amount of change in temperature, the opening degree ratio, or the like) to multiple thresholds.

(7-4) Modification 2D

In the above description, the determination unit 90 detects a leak of the refrigerant. However, the air conditioning apparatus 10 according to the embodiment is not limited thereto. For example, in the air conditioning apparatus 10 according to the embodiment, the determination unit 90 may detect excessive filling of the refrigerant. Furthermore, the amount of excessive filling of the refrigerant may be calculated.

(7-5) Modification 2E

A method in which the determination unit 90 of Modification 2E determines whether the refrigerant amount is appropriate is obtained by slightly changing the method according to the second embodiment.

Figure 12:
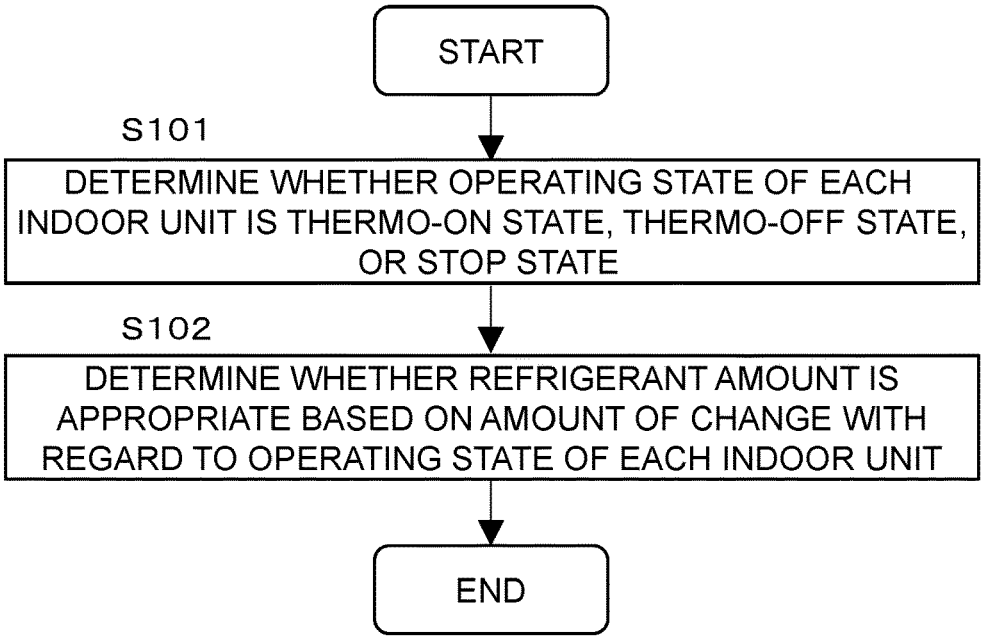
FIG. 12 is a flowchart of a method of determining whether the refrigerant amount is appropriate in heating operation according to Modification 2E.

FIG. 12 is a flowchart of a method of determining whether the refrigerant amount is appropriate in heating operation according to Modification 2E.

In Modification 2E, the determination unit 90 first determines whether the operating state of each of the indoor units 40, 50, and 60 is a thermo-on state, a thermo-off state, or a stop state in step S101. Such determination is made mainly because the retaining amount of the refrigerant varies depending on each state. Description is given below in more detail. The following description is for heating operation.

When an indoor unit is in the thermo-on state, the indoor expansion valve 41, 51, or 61 has the opening degree in operation, the indoor fan 43, 53, or 63 rotates, and the refrigerant is retained in the indoor unit by a refrigerant amount with a certain liquid-gas ratio.

When the indoor unit is stopped, the indoor expansion valve 41, 51, or 61 has the minimum opening degree, and the indoor fan 43, 53, or 63 is stopped. The amount of refrigerant held in the indoor unit is generally the amount of refrigerant equivalent to that in the indoor unit in the thermo-on state although the amount of refrigerant varies depending on the installation state.

When the indoor unit is in the thermo-off state, the indoor expansion valve 41, 51, or 61 has the minimum opening degree, and the indoor fan 43, 53, or 63 is rotated at a fixed minimum airflow volume. The refrigerant held in the indoor unit is progressively condensed through rotation of the fan and the amount of liquid increases. The refrigerant amount increases as compared to the refrigerant amount in the indoor unit in the thermo-on state.

After the operating state of each of the indoor units 40, 50, and 60 is determined in step S101, the determination unit 90 determines whether the refrigerant amount is appropriate with regard to the operating state in step S102. For example, when the number of the indoor units in the thermo-off state increases among the indoor units, it is determined whether the refrigerant amount is appropriate with regard to a situation in which the amount of refrigerant circulating in the entire indoor unit decreases. The determination on the refrigerant amount by the determination unit 90 in step S102 is similar to that of the first embodiment or the second embodiment except that the determination is made with regard to the operating state of each of the indoor units 40, 50, and 60.

(7-6) Modification 2F

A method in which the determination unit 90 of Modification 2F determines whether the refrigerant amount is appropriate is obtained by slightly changing the method according to Modification 2E.

Figure 13:
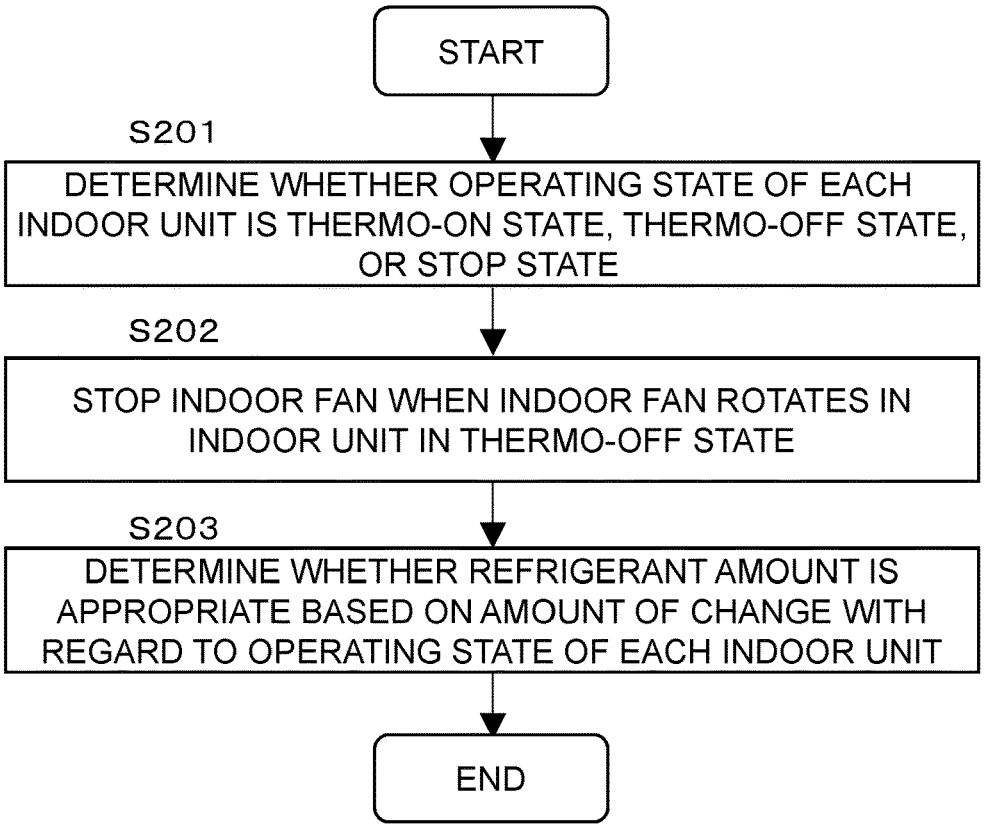
FIG. 13 is a flowchart of a method of determining whether the refrigerant amount is appropriate in heating operation according to Modification 2F.

FIG. 13 is a flowchart of a method of determining whether the refrigerant amount is appropriate in heating operation according to Modification 2F.

In Modification 2F, like Modification 2E, the determination unit 90 first determines whether the operating state of each of the indoor units 40, 50, and 60 is a thermo-on state, a thermo-off state, or a stop state in step S201.

Then, in step S202, in an indoor unit in the thermo-off state, when the indoor fan 43, 53, or 63 rotates, the indoor fan 43, 53, or 63 is stopped. In other words, when the indoor unit is in the thermo-off state, the indoor unit is controlled to be in the same state as the stop state. The reason is to decrease the retaining amount of the refrigerant because the retaining amount of the refrigerant in the thermo-off state is large.

In step S203, it is determined whether the refrigerant amount is appropriate on the basis of the operating state after the change in step S202. This step S203 is the same as step S102 in Modification 2E.

(7-7) Modification 2G

A method in which the determination unit 90 of Modification 2G determines whether the refrigerant amount is appropriate is obtained by slightly changing the method according to the second embodiment.

Figure 14:
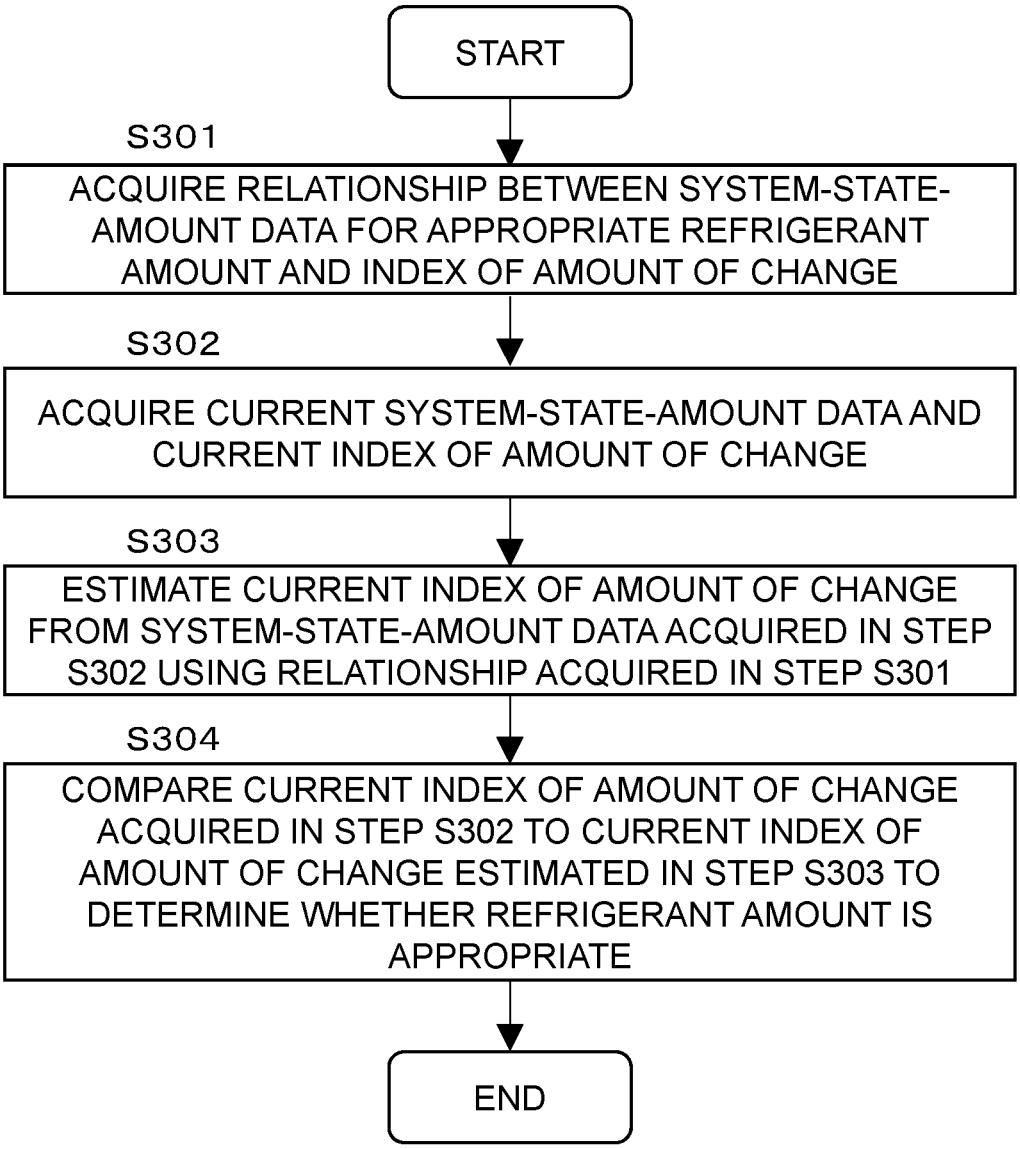
FIG. 14 is a flowchart of a method of determining whether the refrigerant amount is appropriate in heating operation according to Modification 2G.

FIG. 14 is a flowchart of a method of determining whether the refrigerant amount is appropriate in heating operation according to Modification 2G.

In Modification 2G, the relationship between system-state-amount data for an appropriate refrigerant amount and an index of the amount of change is acquired in advance (S301). "In advance" represents, for example, a time point when it is supposed that the refrigerant amount is appropriate and the operation is normal in the past, in a situation where the refrigerant may currently leak and it is desirable to determine whether the refrigerant amount is appropriate. The air conditioning apparatuses 10 and 10*a* each further include a memory. The acquired data is stored in the memory.

The system-state-amount data includes at least one of the number of revolutions of the compressor, an indoor-unit capacity, an outside air temperature, and an opening degree of the subcooling expansion mechanism.

Steps in step S302 and later are performed at a time point when it is desirable to determine whether the refrigerant amount is appropriate.

In step S302, current system-state-amount data and a current index of the amount of change are acquired.

In step S303, the relationship between the system-state-amount data for the appropriate refrigerant amount and the index of the amount of change acquired in step S301 is read from the memory, and a current index of the amount of change is estimated from the system-state-amount data acquired in step S302.

In step S304, the current index of the amount of change acquired in step S302 is compared to the current index of the amount of change acquired in step S303, and it is determined whether the refrigerant amount is appropriate.

Note that it is preferable to use the system-state-amount data and data on the index of the amount of change to be used in step S303 or S304, both the data being acquired in a state of compressor suction superheating degree >0. The reason is described as follows.

When the refrigerant stored in the accumulator 24 is no longer left in a state in which the refrigerant is insufficient in heating operation, since the outside air temperature is higher than the evaporation temperature, the compressor suction superheating degree continuously increases. In other words, in the state in which the refrigerant is insufficient, the state of compressor suction superheating degree >0 is obviously established.

In contrast, when the heating operation is performed with the appropriate refrigerant amount, the refrigerant is stored in the accumulator 24, and the temperature at the outlet of the accumulator 24 is a gas saturation temperature. Hence, the compressor suction superheating degree is close to 0.

Thus, when only the data in the state of compressor suction superheating degree >0 is used in heating operation, the data is highly possibly data in the state in which the refrigerant is not stored in the accumulator 24, or in other words, data in the state in which the refrigerant is insufficient.

An example indicative of how the system-state-amount data affects the index of the amount of change is briefly described.

For example, the number of revolutions of the compressor serves as the system state amount, and the intermediate-pressure correspondence value serves as the index of the amount of change. When the load of heating increases and the number of revolutions of the compressor increases, the subcooling degree increases. As the subcooling degree increases, the intermediate-pressure correspondence value increases.

(7-8) Modification 2H

Figure 15:
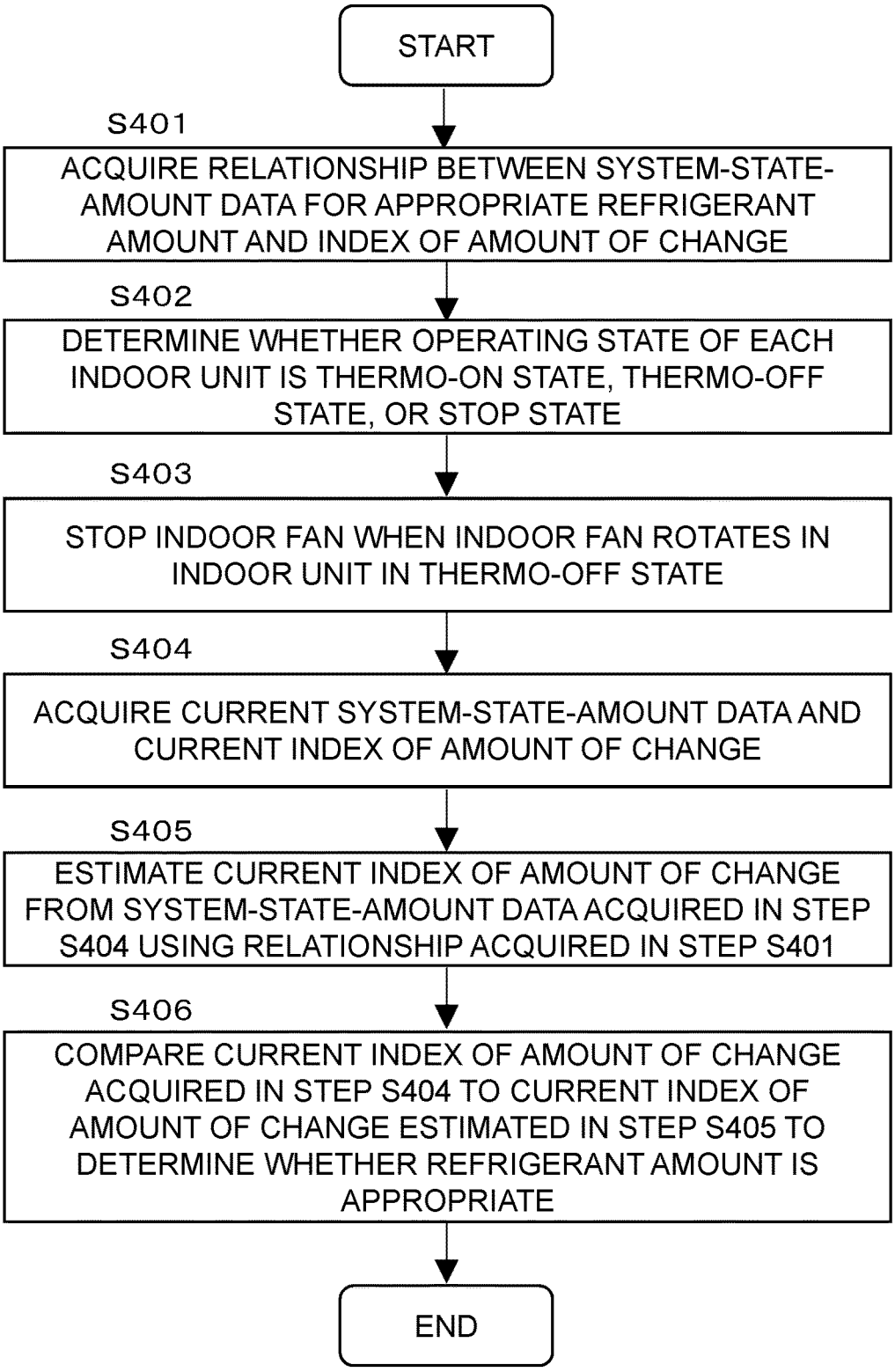
FIG. 15 is a flowchart of a method of determining whether the refrigerant amount is appropriate in heating operation according to Modification 2H.

A method in which the determination unit 90 of Modification 2H determines whether the refrigerant amount is appropriate is obtained by slightly changing the method according to the second embodiment. Modification 2H is a combination of Modification 2G and Modification 2F. FIG. 15 is a flowchart of a method of determining whether the refrigerant amount is appropriate in heating operation according to Modification 2H.

In Modification 2H, like Modification 2G, the relationship between system-state-amount data for an appropriate refrigerant amount and an index of the amount of change is acquired in advance (S401).

Steps in step S402 and later are performed at a time point when it is desirable to determine whether the refrigerant amount is appropriate.

In Modification 2H, like Modification 2F, the determination unit 90 determines whether the operating state of each of the indoor units 40, 50, and 60 is a thermo-on state, a thermo-off state, or a stop state in step S402.

Then, in step S403, in an indoor unit in the thermo-off state, when the indoor fan 43, 53, or 63 rotates, the indoor fan 43, 53, or 63 is stopped.

In step S404, current system-state-amount data and a current index of the amount of change are acquired. The acquired data are stored in the memory.

In step S405, the relationship between the system-state-amount data for the appropriate refrigerant amount and the index of the amount of change acquired in step S401 is read from the memory, and a current index of the amount of change is estimated from the system-state-amount data acquired in step S404.

In step S406, the index of the current amount of change acquired in step S404 is compared to the current index of the amount of change acquired in step S405, and it is determined whether the refrigerant amount is appropriate.

Other Embodiments

Although the embodiments have been described, it should be understood that the embodiments and the details thereof are changeable in various ways without departing from the idea and scope of the claims.

That is, the present disclosure is not limited to the embodiments. According to the present disclosure, the components can be modified and embodied within the scope not departing from the gist of the disclosure in the implementation phase. Moreover, according to the present disclosure, various types of disclosure can be formed by appropriate combinations of the plurality of components disclosed in the above-described embodiments. For example, some components may be omitted from the whole components provided in the embodiments. Furthermore, the components between different embodiments may be combined appropriately.

REFERENCE SIGNS LIST

10 air conditioning apparatus
11 refrigerant circuit
20 outdoor unit
22 four-way switching valve (switching mechanism)
23 outdoor heat exchanger
24 accumulator (container)
34 liquid-side temperature sensor
37 outdoor-side controller
38 outdoor expansion valve (outdoor expansion mechanism)
40 indoor unit
41 indoor expansion valve (indoor expansion mechanism)
42 indoor heat exchanger
44 liquid-side temperature sensor
47 indoor-side controller
50 indoor unit
51 indoor expansion valve
52 indoor heat exchanger (indoor expansion mechanism)
54 liquid-side temperature sensor
57 indoor-side controller
60 indoor unit
61 indoor expansion valve
62 indoor heat exchanger (indoor expansion mechanism)
64 liquid-side temperature sensor
67 indoor-side controller
71 liquid-side connection pipe
74 liquid-side refrigerant temperature sensor
80 control unit
90 determination unit
95 communication unit
110 branch pipe
112 subcooling expansion valve (branch-pipe expansion mechanism)

CITATION LIST

Patent Literature

PTL 1: Japanese Patent No. 5164527

The invention claimed is:

1. An air conditioning apparatus comprising a refrigerant circuit in which a plurality of indoor units each respectively comprising an indoor heat exchanger and an indoor expansion mechanism are connected to an outdoor unit including an outdoor expansion mechanism via a connection pipe, the air conditioning apparatus individually controlling each of the indoor units to operate or stop, the air conditioning apparatus further comprising:

a controller that, when at least one of the indoor heat exchangers functions as a radiator, controls an opening degree of the indoor expansion mechanism of the at least one indoor heat exchanger functioning as the radiator and an opening degree of the outdoor expansion mechanism; wherein said apparatus determines, while the at least one indoor heat exchanger functions as a radiator; whether a refrigerant amount in the refrigerant circuit is appropriate on the basis of an amount of change corresponding to a change in state of a refrigerant between the indoor expansion mechanism of the at least one indoor heat exchanger functioning as the radiator and the outdoor expansion mechanism.

2. The air conditioning apparatus according to claim 1, wherein the outdoor unit further comprises:

a compressor that compresses and discharges refrigerant, an outdoor heat exchanger, a switching valve that switches a flow path of the refrigerant to cause each indoor heat exchanger to function as a radiator or an evaporator, and a container connected to an upstream-side pipe of the refrigerant circuit to store the refrigerant, the upstream-side pipe being located upstream of the compressor.

3. The air conditioning apparatus according to claim 2, wherein the outdoor unit further comprises:

a branch pipe located between an upstream-side pipe located upstream of the outdoor heat exchanger and the upstream-side pipe located upstream of the compressor in operation in which the outdoor heat exchanger is used as an evaporator, and a branch-pipe expansion mechanism disposed in the branch pipe.

4. The air conditioning apparatus according to claim 1, wherein the apparatus determines the amount of change on the basis of an opening degree ratio of the opening degree of the indoor expansion mechanism of the at least one indoor heat exchanger functioning as the radiator to the opening degree of the outdoor expansion mechanism.

5. The air conditioning apparatus according to claim 1, wherein each of the indoor expansion mechanisms is connected in series to the outdoor expansion mechanism via the connection pipe, and wherein the apparatus determines the amount of change on the basis of a temperature of the connection pipe between the indoor expansion mechanisms and the outdoor expansion mechanism.

6. The air conditioning apparatus according to claim 5, wherein a temperature of the connection pipe is measured by a temperature sensor disposed in the outdoor unit.

7. The air conditioning apparatus according to claim 5, wherein a temperature of the connection pipe is measured by a temperature sensor disposed at a position located downstream of a position at which pipes from the plurality of indoor expansion mechanisms are joined.

8. The air conditioning apparatus according to claim 5, wherein a temperature of the connection pipe is measured by each of a plurality of temperature sensors respectively disposed in each one of the plurality of indoor units.

9. The air conditioning apparatus according to claim 1, wherein the apparatus determines whether the refrigerant amount is appropriate based on whether an operating state of the indoor unit is a thermo-on state, a thermo-off state, or a stop state.

10. The air conditioning apparatus according to claim 1, wherein each indoor unit further comprises an indoor fan that circulates air to the corresponding indoor heat exchanger of the indoor unit, and wherein, in a case where the indoor fan operates in a thermo-off state, after the controller stops the indoor fan of the indoor unit in the thermo-off state, the apparatus determines whether the refrigerant amount is appropriate.

11. The air conditioning apparatus according to claim 1, wherein the apparatus acquires a relationship between system-state-amount data for an appropriate refrigerant amount and an index of the amount of change in advance, and wherein, the apparatus determines whether the refrigerant amount is appropriate by using the relationship to compare an index of the amount of change that is estimated on the basis of current system-state-amount data to a current index of the amount of change.

12. The air conditioning apparatus according to claim 11, wherein the index of the amount of change is a temperature of the connection pipe between the indoor expansion mechanism and the outdoor expansion mechanism.

13. The air conditioning apparatus according to claim 11, wherein, when a pressure of a refrigerant discharged from the compressor is a high pressure, a physical property value corresponding to the high pressure is a high-pressure correspondence value, when a pressure of a refrigerant before being sucked to the compressor is a low pressure, a physical property value corresponding to the low pressure is a low-pressure correspondence value, and when a pressure of the connection pipe between the indoor expansion mechanism and the outdoor expansion mechanism is an intermediate pressure, a physical property value corresponding to the intermediate pressure is an intermediate-pressure correspondence value, the index of the amount of change is represented by: (the intermediate-pressure correspondence value−the low-pressure correspondence value)/(the high-pressure correspondence value−the low-pressure correspondence value).

14. The air conditioning apparatus according to claim 11, wherein the system-state-amount data includes at least one of a number of revolutions of the compressor, an indoor-unit capacity, an outside air temperature, and an opening degree of a subcooling expansion mechanism.

15. The air conditioning apparatus according to claim 11, wherein, the system-state-amount data and index data of the amount of change used to determine whether the refrigerant amount is appropriate are only data acquired in a state of a compressor suction superheating degree >0.

16. The air conditioning apparatus according to claim 6, wherein the temperature sensor is provided at the connection pipe.

17. The air conditioning apparatus according to claim 2, wherein the apparatus determines the amount of change on the basis of an opening degree ratio of the opening degree of the indoor expansion mechanism of the at least one indoor heat exchanger functioning as the radiator to the opening degree of the outdoor expansion mechanism.

18. The air conditioning apparatus according to claim 3, wherein the apparatus determines the amount of change on the basis of an opening degree ratio of the opening degree of the indoor expansion mechanism of the at least one indoor heat exchanger functioning as the radiator to the opening degree of the outdoor expansion mechanism.

19. An air conditioning apparatus comprising a refrigerant circuit in which a plurality of indoor units each respectively comprising an indoor heat exchanger and an indoor expansion mechanism are connected to an outdoor unit comprising an outdoor expansion mechanism via a connection pipe, the air conditioning apparatus individually controlling each of the indoor units to operate or stop, the air conditioning apparatus comprising:

a controller that, when at least one of the indoor heat exchangers functions as a radiator, controls an opening degree of the indoor expansion mechanism of the at least one indoor heat exchanger functioning as the radiator and an opening degree of the outdoor expansion mechanism; and a transmitter that transmits an amount of change corresponding to a change in state of a refrigerant between the indoor expansion mechanism of the at least one indoor heat exchanger functioning as the radiator and the outdoor expansion mechanism, to a management device that determines whether a refrigerant amount in the refrigerant circuit is appropriate on the basis of the amount of change.

20. A management device communicable with an air conditioning apparatus comprising a refrigerant circuit in which a plurality of indoor units each respectively comprising an indoor heat exchanger and an indoor expansion mechanism are connected to an outdoor unit including an outdoor expansion mechanism via a connection pipe, the air conditioning apparatus individually controlling each of the indoor units to operate or stop, the air conditioning apparatus further including a controller that, when at least one of the indoor heat exchangers functions as a radiator, controls an opening degree of the indoor expansion mechanism of the at least one indoor heat exchanger functioning as the radiator and an opening degree of the outdoor expansion mechanism, wherein the management device acquires an amount of change corresponding to a change in state of a refrigerant between the indoor expansion mechanism of the at least one indoor heat exchanger functioning as the radiator and the outdoor expansion mechanism, and determines whether a refrigerant amount in the refrigerant circuit is appropriate on the basis of the acquired amount of change.

* * * * *